US008561366B2

(12) United States Patent
Gasperi

(10) Patent No.: US 8,561,366 B2
(45) Date of Patent: Oct. 22, 2013

(54) CONNECTION SYSTEM FOR CONNECTING CONSTRUCTION ELEMENTS SUITABLE FOR USE IN THE CONSTRUCTION OF BUILDINGS

(76) Inventor: Antonello Gasperi, Modena (IT)

( * ) Notice: Subject to any disclaimer, the term of this patent is extended or adjusted under 35 U.S.C. 154(b) by 283 days.

(21) Appl. No.: 12/909,077

(22) Filed: Oct. 21, 2010

(65) Prior Publication Data

US 2011/0094183 A1 Apr. 28, 2011

(30) Foreign Application Priority Data

Oct. 22, 2009 (IT) ..... PR2009A0083

(51) Int. Cl.
*E04H 1/00* (2006.01)

(52) U.S. Cl.
USPC ..... 52/235; 52/293.3; 52/483.1; 52/506.06; 52/698

(58) Field of Classification Search
USPC ..... 52/698–699, 235, 463, 701, 704, 483.1, 52/707–708, 489.1, 710, 383, 202, 294, 52/506.04, 506.06, 293.3, 293.1, 261–263
See application file for complete search history.

(56) References Cited

U.S. PATENT DOCUMENTS

| | | | | |
|---|---|---|---|---|
| 1,924,884 | A | 8/1933 | Schaffert | |
| 1,934,760 | A * | 11/1933 | Awbrey | 52/710 |
| 2,967,692 | A | 1/1961 | Isidore | |
| 4,194,333 | A * | 3/1980 | Paton et al. | 52/235 |
| 4,782,635 | A * | 11/1988 | Hegle | 52/126.4 |
| 4,905,444 | A * | 3/1990 | Semaan et al. | 52/710 |
| 5,548,939 | A * | 8/1996 | Carmical | 52/707 |
| 5,711,122 | A * | 1/1998 | Lee | 52/283 |
| 7,681,366 | B2 * | 3/2010 | De Gobbi | 52/235 |
| 2008/0098681 | A1 | 5/2008 | Hatzinikolas | |

FOREIGN PATENT DOCUMENTS

| | | | |
|---|---|---|---|
| DE | 1683213 | A1 | 8/1970 |
| DE | 9215771 | U1 | 2/1993 |
| GB | 324451 | A | 1/1930 |
| GB | 399581 | A | 10/1933 |

OTHER PUBLICATIONS

Italian Search Report, dated Jul. 8, 2010, from corresponding PCT application.

* cited by examiner

*Primary Examiner* — Jeanette E. Chapman
(74) *Attorney, Agent, or Firm* — Young & Thompson

(57) ABSTRACT

The invention relates to the field of techniques for connecting construction elements suitable for use in the construction of buildings, in the sector of civil engineering. The connection system (1) connects a first construction element (2) to a second construction element (3) and comprises at least one retaining element (1*a*) integral with the first construction element (2) and an anchoring device (1*b*) connecting the retaining element (1*a*) to the second construction element (3); the anchoring device (1*b*) comprises two wings (4) and a middle part (5), which connects the two wings (4) and is placed in contact with the retaining element (1*a*); the intrados of the two wings (4) lies on a same plane; the axes of the two wings (4) provide an angle therebetween with the vertex pointing the first construction element (2); each of the two wings (4) is connected to the second construction element (3).

20 Claims, 24 Drawing Sheets

CONNECTION SYSTEM FOR CONNECTING CONSTRUCTION ELEMENTS SUITABLE FOR USE IN THE CONSTRUCTION OF BUILDINGS

The object of the present invention is a connection system for connecting construction elements suitable for use in the construction of buildings. In the construction technique, different typologies of connection systems are known, which are suitable to connect a first construction element (such as a reinforced concrete precast cladding panel) to a second construction element (such as a reinforced concrete beam or a prestressed concrete beam). In the very frequent case where a first construction element (a precast cladding panel) has to be connected to a second construction element (a beam), the following two typologies of steel-made connection systems may be considered, inter alia.

A connection system belonging to the first one of said two typologies, supposing that the beam to which the (reinforced concrete) precast panel is connected is made of concrete (either reinforced or prestressed), comprises a retaining element that is placed in the vertical position, which is integral with the precast panel (it shall be understood that said retaining element is partially embedded in the concrete of the precast panel), a further retaining element that is placed in the horizontal position, which is integral with the beam (it shall be understood that said further retaining element is partially embedded in the concrete of the beam), an anchoring device, a toothed plate, an anchoring-headed screw, and a nut screwed to said anchoring-headed screw. Said anchoring device consists of a substantially flat element provided with an anchoring head and a slot; the anchoring device is, proximate to the slot, provided with toothing at the extrados thereof. The toothed plate is provided with a circular hole for the anchoring-headed screw to pass therethrough and with toothing at the intrados thereof. The retaining element consists of a channel element, with vertical axis, with connection elements being integral therewith, such as connectors, anchoring stirrups, etc. The further retaining element consists of a channel element, with horizontal axis, which is integral with connection elements, such as connectors, anchoring stirrups, etc. During service life, the resulting situation is as follows: the anchoring head of the anchoring device is placed within the retaining element (integral with the precast panel) and counteracts parts of the retaining elements; the anchoring-headed screw, which is placed in the vertical position, is inserted in the circular hole of the toothed plate and in the slot of the anchoring device; the anchoring head of the screw (with anchoring head) is placed within the further retaining element and counteracts parts of said further retaining element; said nut is screwed on the anchoring-headed screw and counteracts the extrados (not toothed) of the toothed plate; the toothed plate has the toothing inserted between the toothing of the anchoring device; it should be understood that said nut is tightened against the extrados of said toothed plate. Said precast panel is connected to said beam by means of said connection system which prevents, during service life, the two construction elements from displacing from each other in the direction of the axis of the anchoring device.

A connection system belonging to the above-mentioned second typology of connection systems (which is particularly used in the American market) comprises a retaining element, placed in the vertical position, which is integral with the reinforced concrete precast panel (it should be understood that said retaining element is partially embedded in the concrete of said precast panel), and an anchoring element (made of steel). The retaining element consists of a slotted insert comprising a suitably-shaped metal element, connection elements integral with said slotted insert, and an element made of synthetic material which closes said metal element laterally and below. For simplicity of description, the beam to which the precast panel is connected is supposed to be made of steel and to have horizontal axis. Said anchoring device comprises a flat element having a substantially rectangular plan, a (partially threaded) pin integral with (welded to) said flat element, a washer, a locking nut screwed to said pin, a steel block provided with a threaded hole in which the end (proximate to the precast panel) of said pin is screwed, and a spring placed in contact with said block and said element of synthetic material belonging to the slotted insert; said spring that pushes the block against said suitably shaped metal element that belongs to the slotted insert is used during the steps of installing the anchoring device. On service life, the resulting situation is as follows: said block is placed within the retaining element (the retaining element is integral with the precast panel, and i.e. with the first construction element) and counteracts inner parts of the retaining element; the pin end is screwed within the threaded hole provided in said block; the locking nut is screwed to said pin and counteracts the washer which counteracts the outer part of said retaining element; the anchoring device, and more precisely the flat element, is joined to the steel beam (and, i.e. to the second construction element) by being welded at the extrados of the steel beam. Said connection system prevents any relative displacements between the precast panel and the beam on the anchoring device plane; i.e., it prevents any relative displacements both in the direction of the axis of the anchoring device, and in the direction which is orthogonal to said axis (and is contained on the plane of the anchoring device). In case of a beam made of concrete (either reinforced or prestressed), instead of steel, a steel plate is provided at the beam extrados, which plate is suitably fixed in the concrete of the beam; the anchoring device being welded to this steel plate.

It should be pointed out that, in many cases, a predetermined load-bearing capacity is required for the anchoring device, both relative to forces acting in the direction of the axis of the anchoring device, and to forces acting on the plane of the anchoring device, orthogonally to said axis. It is evident that the load-bearing capacity of the anchoring device, to which a force is applied acting on the plane of the anchoring device which is perpendicular to the axis of the anchoring device, with the material composing the anchoring device being the same, strictly depends on the size of the anchoring device, which is subjected to bending and shear stresses on the plane thereof, and on the distance between that part of anchoring device that is welded to the steel beam and the point where said force is applied; said distance (comprised between that part of anchoring device which is welded to the steel beam and the point where said force is applied) depends both on the distance, as indicated in the design, between the precast panel (first construction element) and the beam (second construction element), and on the construction and erection tolerances of the precast panel and of said beam; it should be noticed that, in many cases, said distance may be of a considerable value. With the forces applied being the same, as said distance is increased, the anchoring device requires to be provided with a higher load-bearing capacity, and (with the material being equal), it finally has a greater size and involves greater costs.

Let us consider an anchoring device of the prior art, which connects a first construction element (a precast panel) to a second construction element (a beam), which is subjected to a force acting on the plane of the anchoring device (or in a plane parallel or proximal thereto), perpendicularly to the axis of the anchoring device; this anchoring device has been designed by taking into account a preset value of the distance between the first construction element and the second construction element, and preset values of the tolerances; a drawback of prior art is that, in case said distance is greater than expected, for example due to particularly relevant defects of assembly and/or production, the stresses may be much higher than expected in the anchoring device, because the stresses in the anchoring device are proportional to the final (actual) value of said distance. It should be understood that these accidental increases of stress may be of particular importance when the distance between the first construction element and the second construction element that are connected by means of the connection system had been designed to be of a small if not null value, and accordingly, when small values of stresses had been foreseen for the anchoring device.

Other connection systems are known in the prior art, such as indicated in the patents: DE 9215771, US 2008/098681, U.S. Pat. No. 1,934,760, GB 324451, which are completely different from the above-described connection systems, and which are suitable to connect small and/or lightweight elements e.g. bricks, stones, small blocks, etc., to a rear wall; each one of the connection systems described in the above-mentioned patents does not prevent all those relative displacements between the above-mentioned small elements and the rear wall which lie in the same plane in which the anchoring device (which is part of said connection system) lies, (said plane being as a rule a horizontal plane) and more precisely it does not prevent those relative displacements which are perpendicular to the longitudinal axis of said anchoring device.

An object of the present invention is to provide a connection system suitable to connect a first construction element to a second construction element even when the distance between said two construction elements is great.

A further object of the present invention is to provide a connection system suitable to prevent the relative displacements between the first construction element and the second construction element, on the plane of the anchoring device, both in the direction of the axis of the anchoring device, and in the direction orthogonal to said axis, even when the distance between the first construction element and the second construction element is great.

This and other objects are achieved by means of the connection system for connecting construction elements suitable for use in the construction of buildings, being the object of the present invention, which is characterized by what is provided in the annexed claims.

The characteristics and the advantages of the present invention will be better understood from the description below of several embodiments illustrated by way of non-limiting examples in the annexed drawings, in which.

Figure 2:
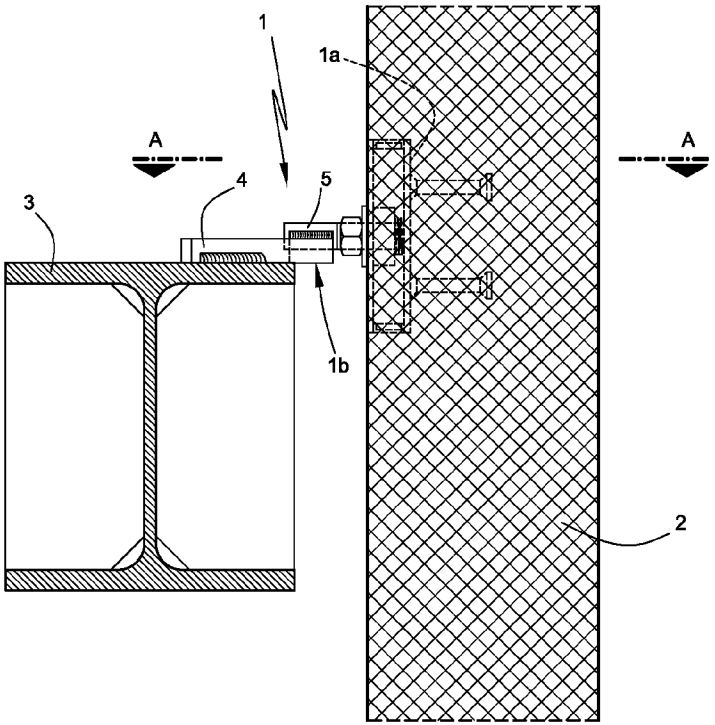
FIG. 2 is a side view, in the same scale as in FIG. 1, of the connection system illustrated in FIG. 1.
Figure 1:
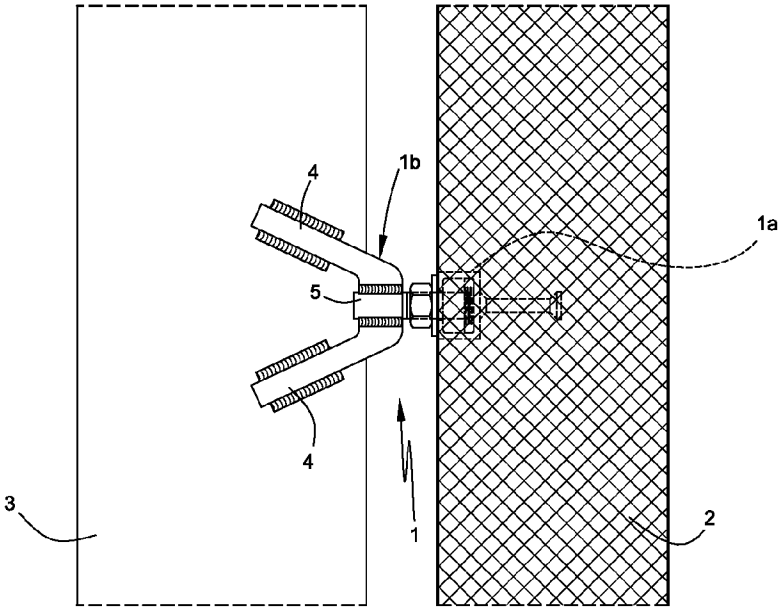
FIG. 1 is a top plan view of a connection system for connecting construction elements suitable for use in the construction of buildings, according to the present invention, according to a first embodiment.
Figure 4:
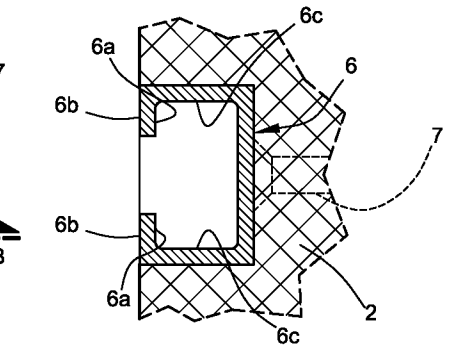
FIG. 4 illustrates, in the same scale as in FIG. 3, a detail of several parts of FIG. 3.
Figure 3:
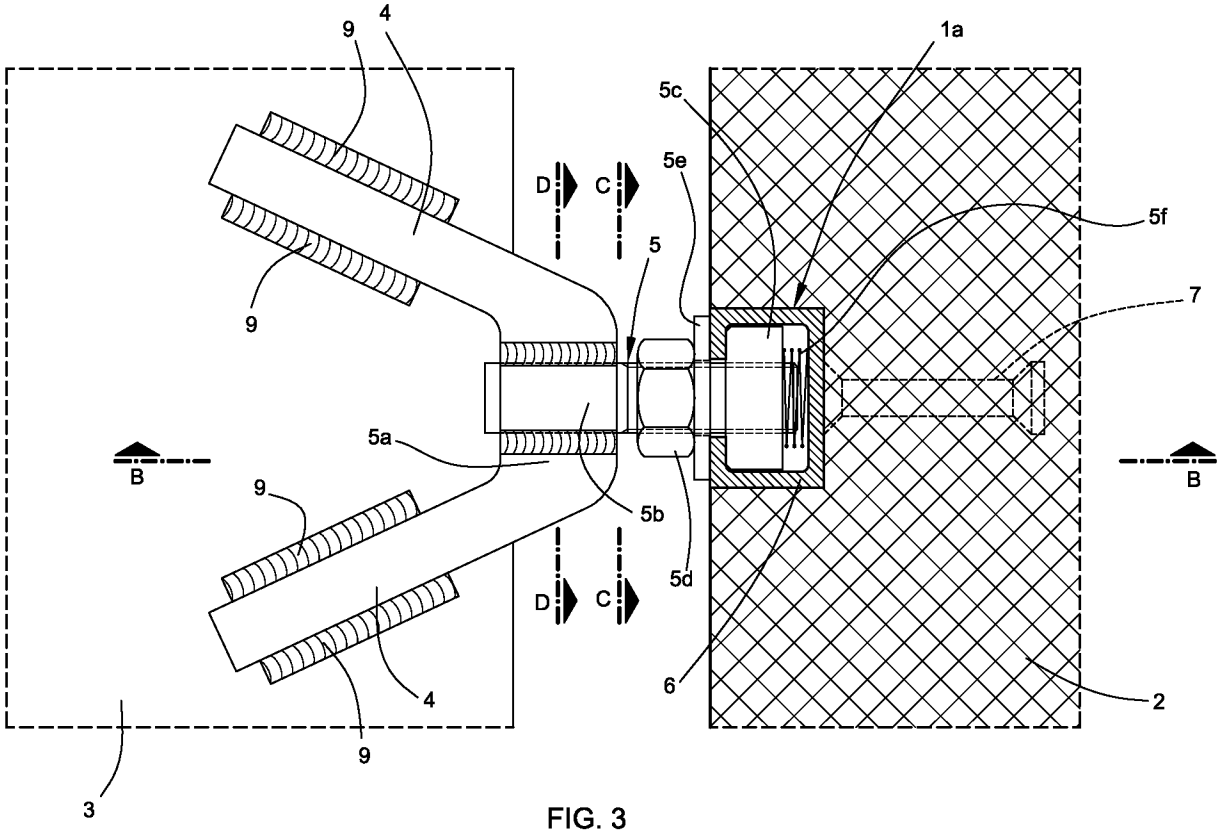
FIG. 3 shows, in greater scale than that in FIG. 1, the section according to the straight line A-A in FIG. 2.
Figure 5:
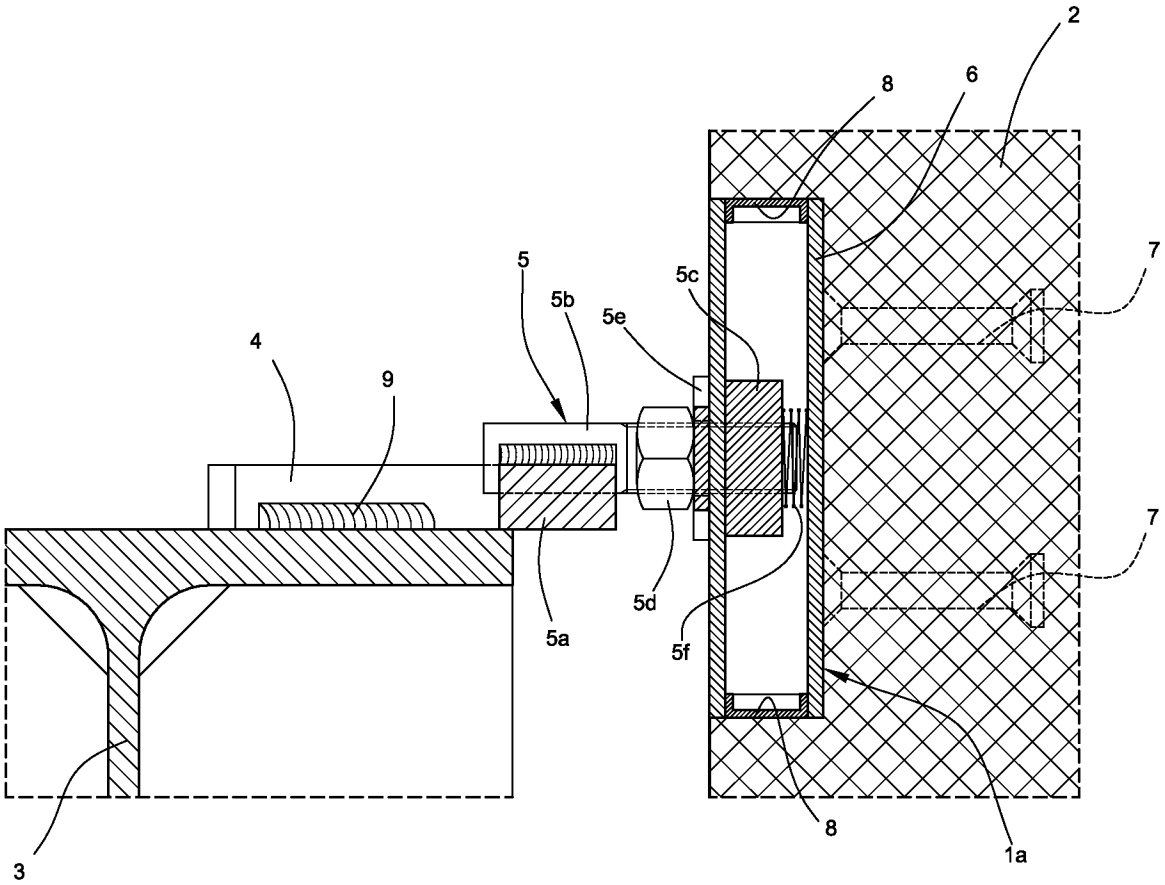
FIG. 5 shows, in the same scale as in FIG. 3, the section according to the straight line B-B in FIG. 3.
Figure 7:
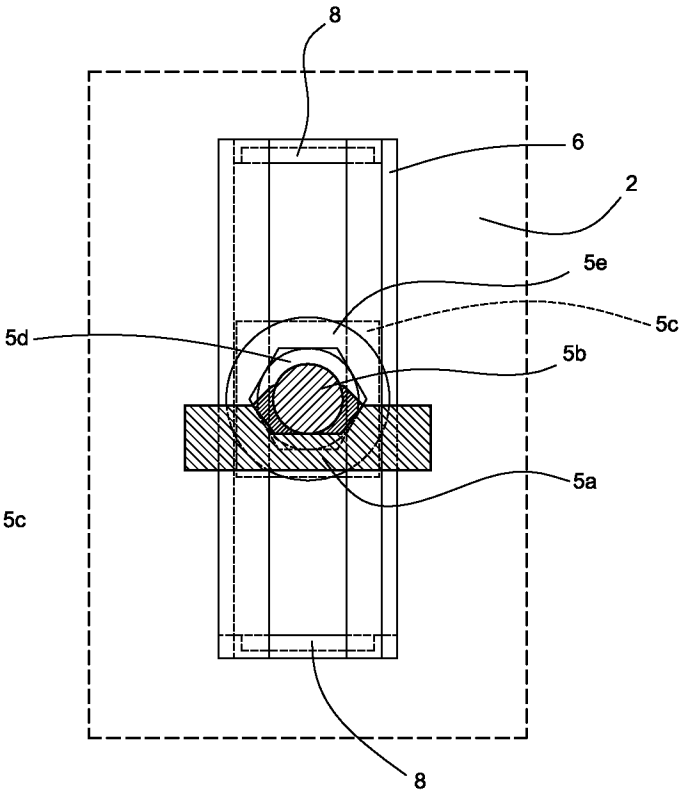
FIG. 7 shows, in the same scale as in FIG. 3, the section according to the straight line D-D in FIG. 3.
Figure 6:
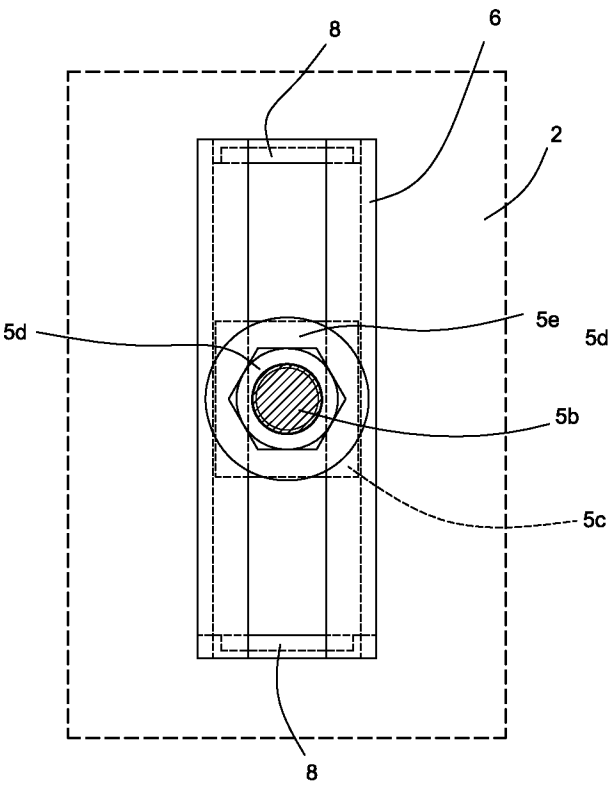
FIG. 6 shows, in the same scale as in FIG. 3, the section according to the straight line C-C in FIG. 3.
Figure 9:
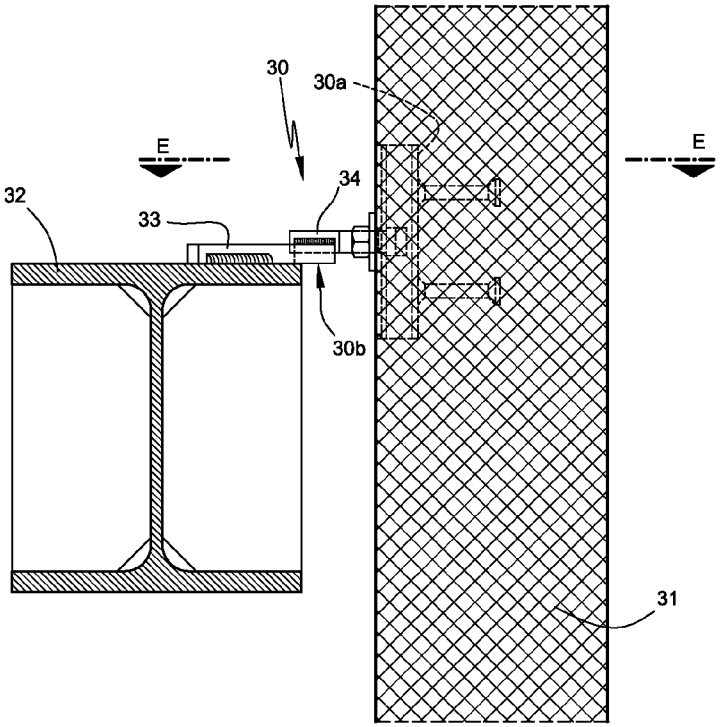
FIG. 9 is a side view, in the same scale as in FIG. 8, of the connection system illustrated in FIG. 8.
Figure 8:
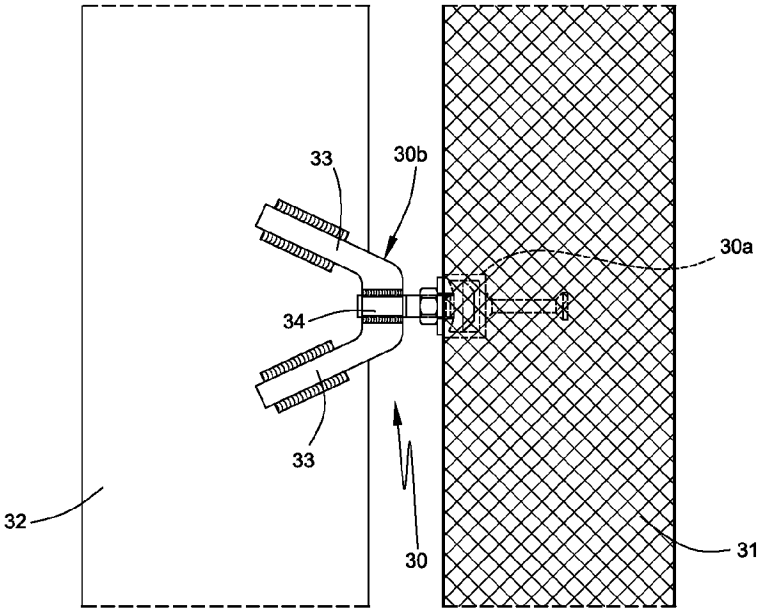
FIG. 8 is a top plan view of a connection system for connecting construction elements suitable for use in the construction of buildings, according to the present invention, according to another embodiment.
Figure 10:
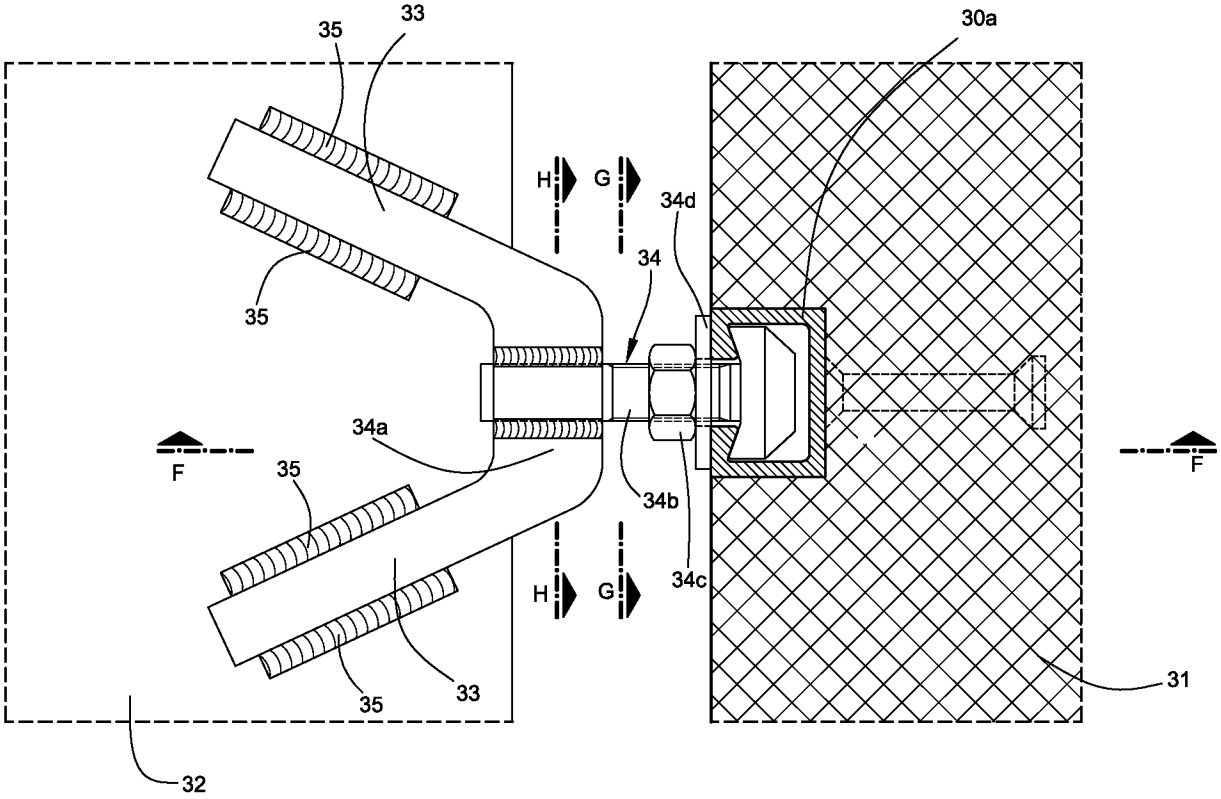
FIG. 10 shows, in greater scale than that in FIG. 8, the section according to the straight line E-E in FIG. 9.
Figure 11:
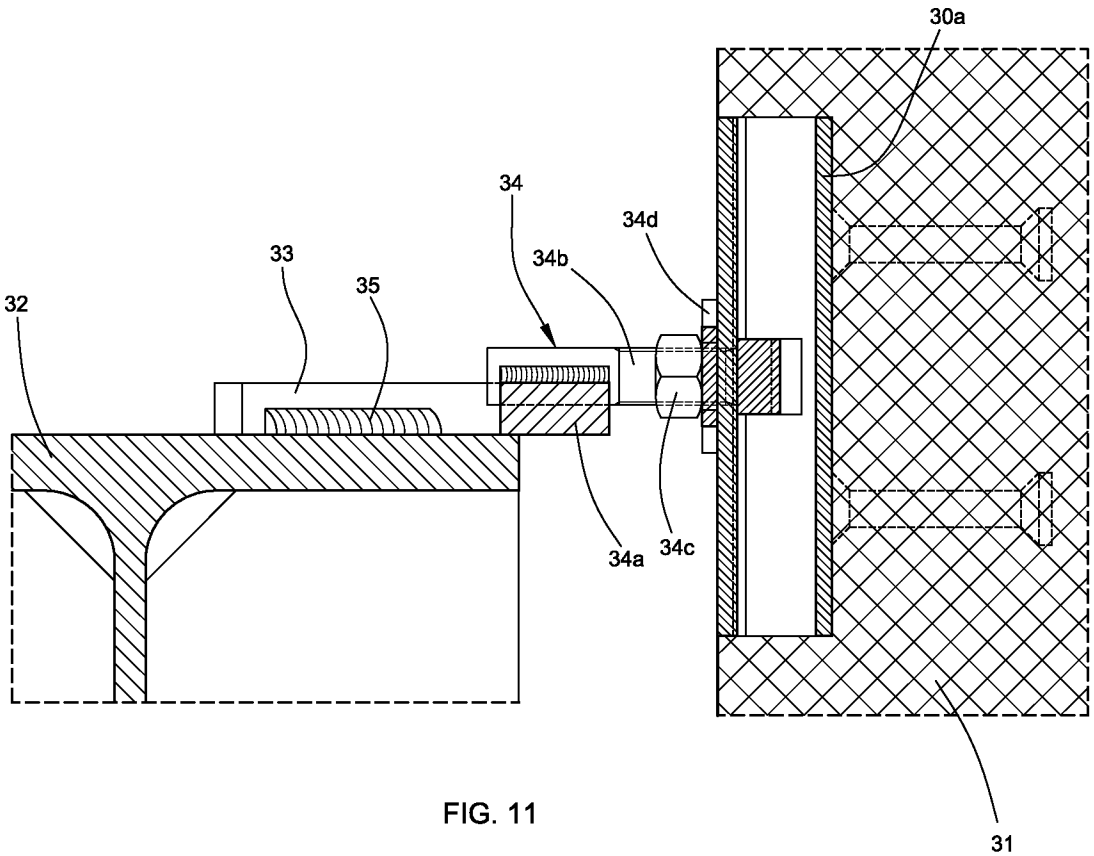
FIG. 11 shows, in the same scale as in FIG. 10, the section according to the straight line F-F in FIG. 10.
Figure 13:
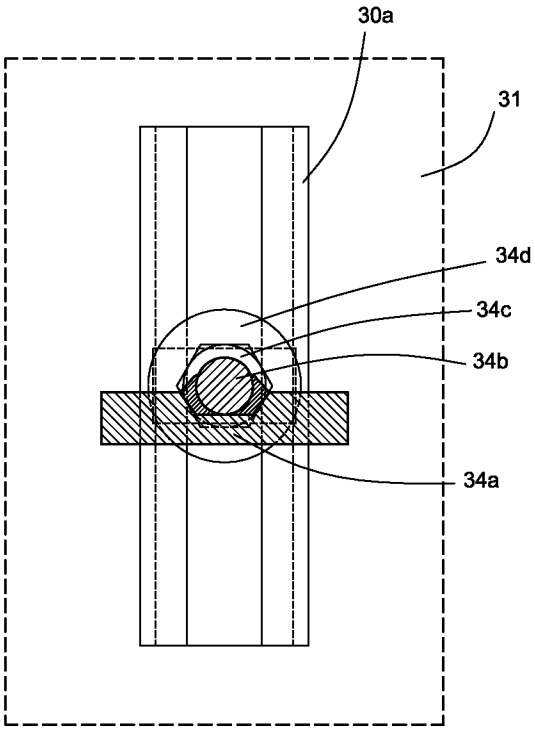
FIG. 13 shows, in the same scale as in FIG. 10, the section according to the straight line H-H in FIG. 10.
Figure 12:
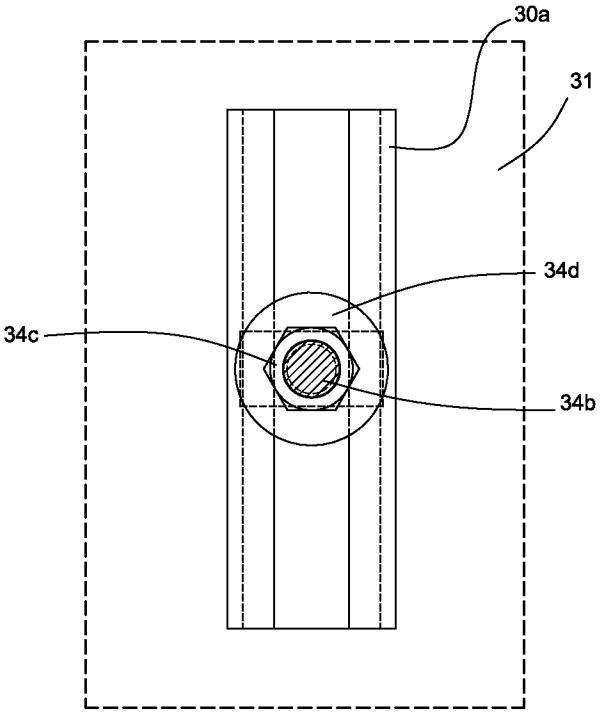
FIG. 12 shows, in the same scale as in FIG. 10, the section according to the straight line G-G in FIG. 10.
Figure 15:
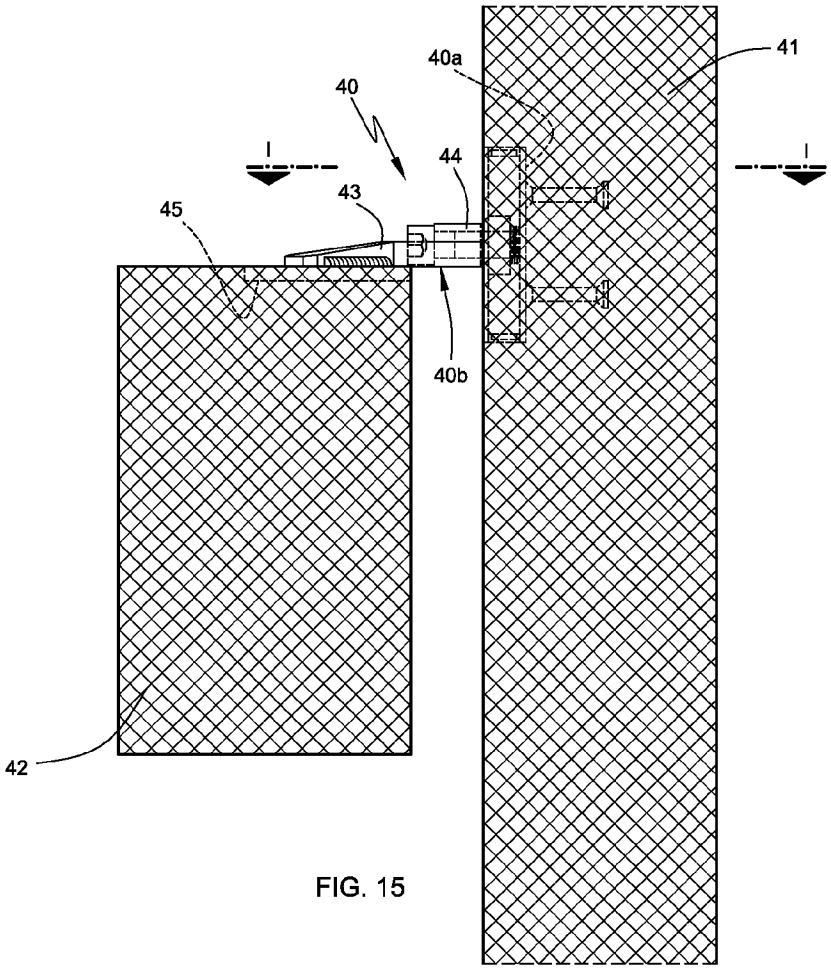
FIG. 15 is a side view, in the same scale as in FIG. 14, of the connection system illustrated in FIG. 14.
Figure 14:
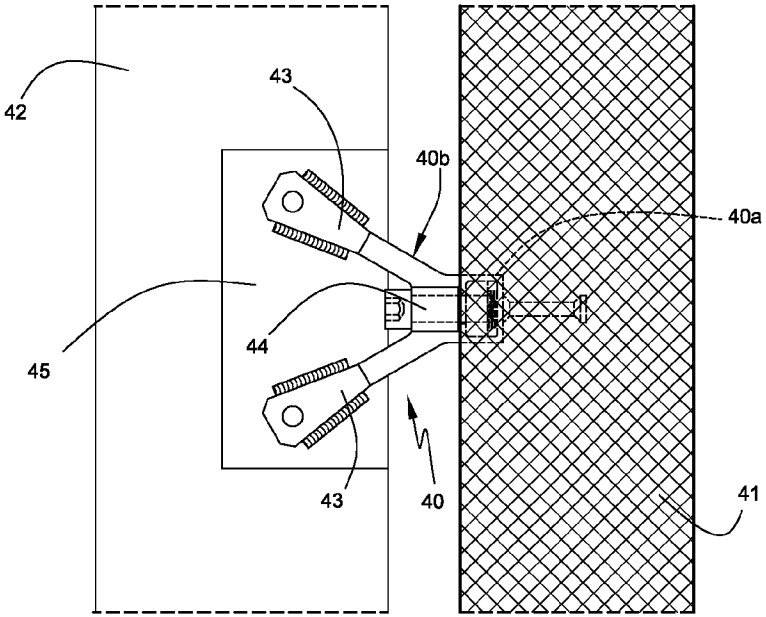
FIG. 14 is a top plan view of a connection system for connecting construction elements suitable for use in the construction of buildings, according to the present invention, according to a further embodiment thereof.
Figure 16:
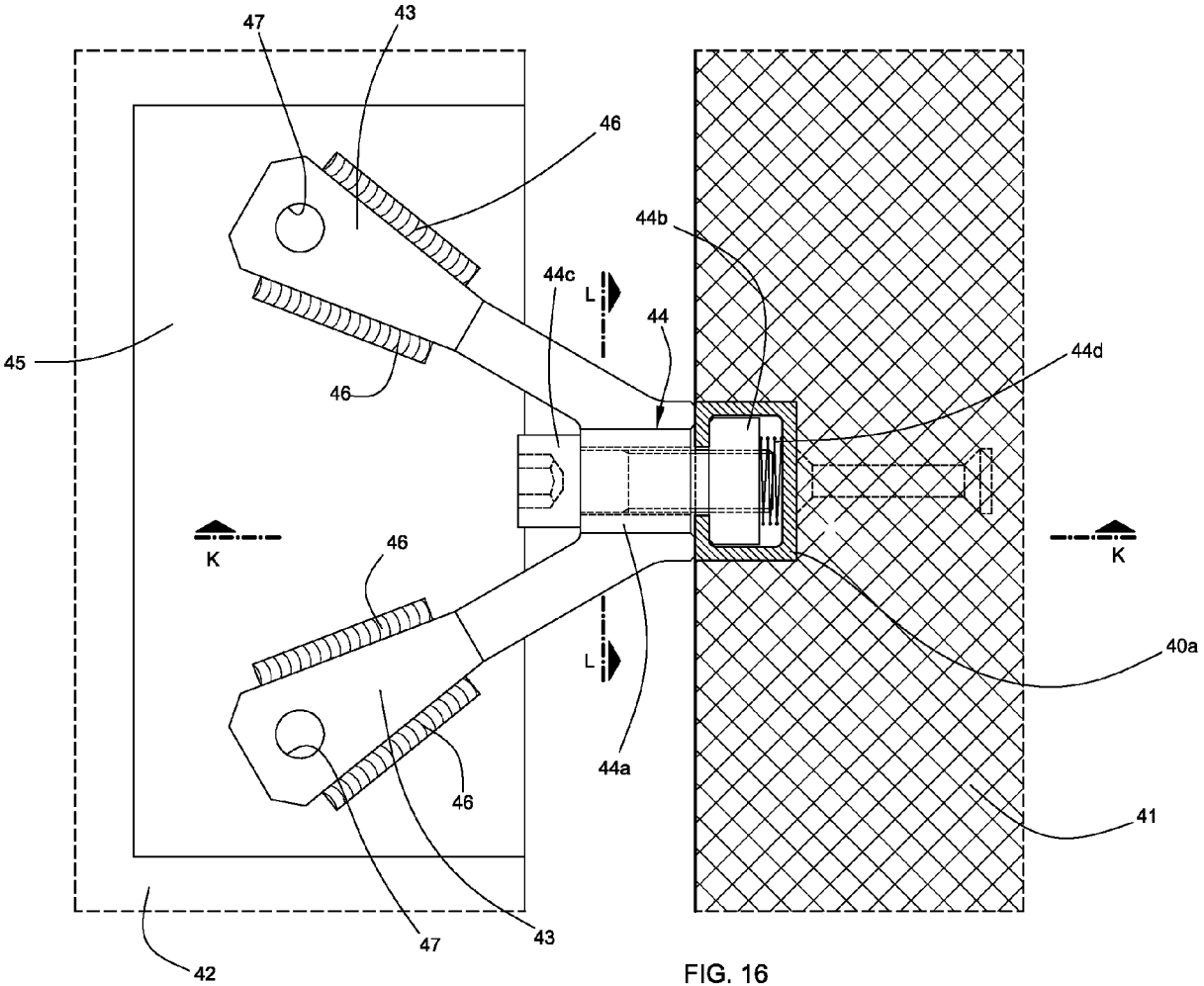
FIG. 16 shows, in greater scale than that in FIG. 14, the section according to the straight line I-I in FIG. 15.
Figure 18:
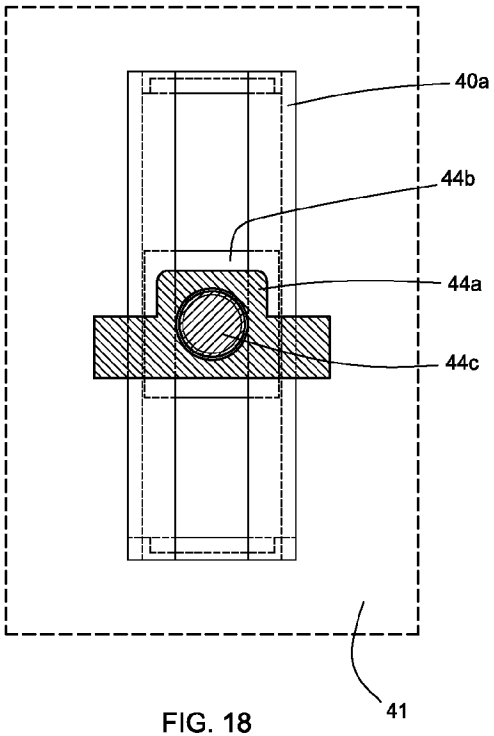
FIG. 18 shows, in the same scale as in FIG. 16, the section according to the straight line L-L in FIG. 16.
Figure 17:
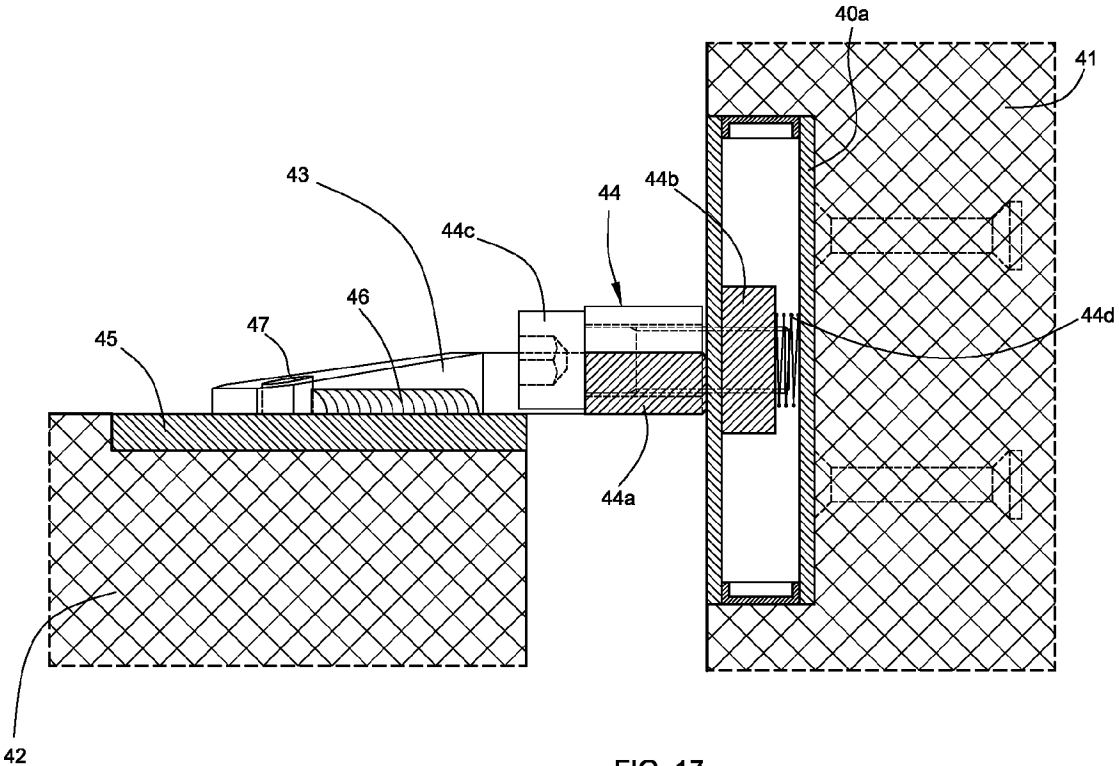
FIG. 17 shows, in the same scale as in FIG. 16, the section according to the straight line K-K in FIG. 16.

Throughout said drawings, for clarity purposes, the reinforcements (either ordinary and/or prestressed) which are provided in the concrete construction elements illustrated in the drawings are not shown.

With reference to FIGS. 1, 2, 3, 4, 5, 6 and 7, a connection system 1, on service life, is described for connecting construction elements that are suitable for use in the construction of buildings, according to the present invention, which connects a first construction element 2 to a second construction element 3 and which comprises a retaining element 1*a*, made of steel, which is integral with the first construction element 2 and an anchoring device 1*b*, made of steel, which connects the retaining element 1*a* to the second construction element 3; the anchoring device 1*b* connects, accordingly, the first construction element 2 to the second construction element 3. The first construction element 2 consists of a reinforced concrete precast cladding panel, which is placed in the vertical position; the second construction element 3 consists of a steel beam; the axis of the second construction element 3 is horizontal.

The anchoring device 1*b* comprises two wings 4 and a middle part 5 which connects the two wings 4 and is placed in contact with the retaining element 1*a*; the intrados of the two wings 4 lies on a same plane; the axes of the two wings 4 provide an angle therebetween with the vertex pointing the first construction element 2; it should be understood that the angle comprised between the axes of the two wings 4 is lower than ninety sexagesimal degrees, the bisector thereof being perpendicular to the outer surface of the first construction element 2, which surface faces the second construction element 3; each of the two wings 4 is connected to the second construction element 3; it should be understood that the two wings 4 are joined to the second construction element 3 by means of welds 9; the connection system 1 prevents, on service life, any relative displacements between the first construction element 2 and the second construction element 3 on the plane where the axes of the two wings 4 lie (it should be understood that the relative displacements are prevented in the direction of the bisector of the angle comprised between the axes of the two wings 4 and in the direction perpendicular to said bisector).

It should be noted that by the expression "the connection system prevents any relative displacements between the first construction element and the second construction element on the plane where the axes of the two wings lie" (or by similar expressions) herein and in the claims below is meant that the connection system prevents any relative displacements between the first construction element and the second construction element, other than on the plane where the axes of the two wings lie, also on the planes parallel to said plane, proximate to said plane.

The middle part 5 comprises a joint area 5*a*, a pin 5*b* which is partially threaded and joined to the joint area 5*a*, a block 5*c* provided with a threaded hole in which the front end (i.e. the end proximate to the first construction element 2) of the pin 5*b* is screwed (this end is inserted in the retaining element 1*a*), a locking nut 5*d* screwed on the pin 5*b* and a washer 5*e*. The pin 5*b* has been welded to the joint area 5*a* in the same factory where the anchoring device 1*b* has been made. The block 5*c* is placed within the retaining element 1*a* and counteracts inner parts of the retaining element 1*a*; the locking nut 5*d*, which is screwed on the pin 5*b*, counteracts, through the washer 5*e*, outer parts of the retaining element 1*a*. The middle part 5 also comprises a spring 5*f* joined to the block 5*c*, which spring counteracts both the block 5*c* and inner parts of the retaining element 1*a*. It should be understood that the axes of the two wings 4 meet at a point that is within the retaining element 1*a*.

The retaining element 1*a* comprises a steel section 6 (this section 6, is sometimes referred to as the "channel element" in prior art), two connectors 7 integral with the section 6 which are embedded in the concrete of the first construction element 2 and two caps 8 closing the section 6 at the ends thereof; in the section 6, two inner rebates 6*a*, two outer rebates 6*b* and two side rebates 6*c* are provided. The section 6 is made by means of hot extrusion.

During the installation of the anchoring device 1*b* the spring 5*f*, which counteracts both inner parts of the section 6 and the block 5*c*, pushes the block 5*c* against the two inner rebates 6*a* thereby holding the block 5*c* in position and facilitating the installation operations; the use of the spring 5*f* only relates to the steps of installing the anchoring device 1*b*. The two caps 8 close the section 6 to avoid that, when the concrete is being cast in order to make the first construction element 2, the concrete may penetrate inside the section 6. Upon making the first construction element 2, a front cap of synthetic material is also provided, not shown in the drawings, which is placed at the two outer rebates 6*b* to prevent the concrete used to make the first construction element 2 from penetrating inside the retaining element 1*a*. During the service life of the connection system 1, the resulting situation is as follows: each of the two wings 4 (of the anchoring device 1*b*) is joined to the second construction element 3 by means of the welds 9 provided at the extrados of the second construction element 3; the (partially threaded) pin 5*b* is screwed within the threaded hole provided in the block 5*c*; the block 5*c* is placed within the section 6 and counteracts both the inner rebates 6*a* and side rebates 6*c* (if horizontal actions are applied to the block 5*c* perpendicularly to the bisector of the angle comprised between the axes of the two wings 4); the locking nut 5*d*, being screwed on the pin 5*b*, counteracts the washer 5*e* which, in turn, counteracts the outer rebates 6*b*. Accordingly, between the first construction element 2 and the second construction element 3 the horizontal relative displacements lying on the plane containing the axes of the two wings 4 are prevented; the vertical relative displacements result to be only hindered by the friction forces existing between the block 5*c* and the section 6 and by the friction forces existing between the washer 5*e* and the section 6.

The operations of installing the connection system 1 comprise the operations indicated below: the retaining element 1*a*, upon making the first construction element 2, is partially embedded in the concrete of the first construction element 2, after the block 5*c* (joined to the spring 5*f*) has been inserted within the retaining element 1*a*, after the two caps 8 have been placed at the ends of the section 6 and after the front part of the section 6 has been closed with the front cap of synthetic material (mentioned above, and not shown in the drawings); subsequently, when the first construction element 2 and the second construction element 3 have been assembled at the building site and are in the final position, the pin 5*b* which is partially threaded and a part of the anchoring device 1*b*, is inserted into the section 6 by screwing the pin 5*b* in the block 5*c* which is hold in position, during this operation, by means of the spring 5*f* that counteracts the inner part of the section 6;

it should be noted that during the operations of screwing the pin 5*b* the anchoring device 1*b* is hold above the extrados of the second construction element 3; in fact, in addition to the pin 5*b*, the two wings 4 and the joint area 5*a*, which are integral with the pin 5*b*, are also (obviously) turned; during these operations the locking nut 5*d*, which is screwed on the pin 5*b*, is placed at a preset distance from the retaining element 1*a*, such as not to hinder the operations of screwing the pin 5*b* into the block 5*c*. The anchoring device 1*b*, after the pin 5*b* has been screwed into the block 5*c*, is vertically translated, by causing the block 5*c* to slide within the section 6 until the two wings 4 come in contact with the extrados of the second construction element 3 and, more precisely, with the upper flange of the steel beam which is the second construction element 3; the locking nut 5*d* is then definitely screwed until the latter, through the washer 5*e*, counteracts the two outer rebates 6*b* of the section 6; finally, the welds 9 are provided, which make the two wings 4 (and accordingly the anchoring device 1*b*) integral with the second construction element 3. After the operations for installing the connection system 1 have been completed, any accidental rotation of the locking nut 5*d* should be avoided, on service life; to the purpose, suitable means, such as a lock nut, a spring washer, etc., can be used, which are not shown in the drawings. It should be noted that the vertical relative displacements between the anchoring device 1*b* and the retaining element 1*a* result to be prevented if the friction forces existing between the washer 5*e* and the outer rebates 6*b* and the friction forces existing between the block 5*c* and the inner rebates 6*a* are greater than the external forces which tend to cause the relative translation, in the vertical direction, between the anchoring device 1*b* and the retaining element 1*a*.

It should be understood that by the expression "the locking nut counteracts outer parts of the retaining element" (or by similar expressions) herein and in the claims below is meant that the locking nut counteracts outer parts of the retaining element, but it is not tightened against said outer parts. Accordingly, with a connection system according to the present invention (as well as with the connection system 1) in the case the locking nut is provided, which counteracts outer parts of the retaining element, the (vertical) relative displacements are normally possible (if the above-mentioned friction forces are exceeded) in the direction of the axis of the retaining element, between the anchoring device and the retaining element (and hence between the first construction element and the second construction element). Similar considerations also apply to expressions like "the block counteracts inner parts of the retaining element".

It is understood that, in case the locking nut is tightened against the washer which accordingly results to be tightened against the retaining element, friction forces are originated such as to strongly counteract the occurrence of relative displacements between the anchoring device and the retaining element.

According to a variant embodiment, not shown in the drawings, in case it is designed that the vertical relative displacements between the first construction element 2 and the second construction element 3 must take place in the presence of low friction forces, the block (which is technically equivalent to the block 5*c*) results to be provided with elements made of PTFE (polytetrafluoroethylene) or of other material suitable to reduce the friction, which elements are integral thereto and placed in contact with the inner rebates 6*a* and with the side rebates 6*c*; furthermore, the washer (which is technically equivalent to the washer 5*e*) is provided with an element made of PTFE or of other material (suitable to reduce the friction) integral therewith, which is placed in contact with the outer rebates 6*b*; thereby, the vertical relative displacements between the anchoring device 1*b* and the retaining element 1*a* can take place without considerable friction forces being originated; also according to this variant embodiment, after the operations of installing the connection system have been completed, any accidental rotation of the locking nut should be avoided, on service life; to the purpose, the above-mentioned suitable means can be used.

In FIGS. 1, 2, 3, and 5 the first construction element 2 and the second construction element 3 are shown as being spaced from each other by several centimeters; it should be understood, however, that the first construction element 2 can also be placed in much closer position to the second construction element 3; it should be also noted that, also in this case, the anchoring device 1*b* can be used because the (vertically measured) distance between the axis of the pin 5*b* and the intrados of the two wings 4 is such that locking nut 5*d* can be rotated during the steps of installing the anchoring device 1*b*, without hindering the extrados of the second construction element 3. It should be noted that, in case the distance between the first construction element 2 and the second construction element 3 (taking into account the construction and erection tolerances) is greater than the sum of the thickness of the locking nut 5*d* and of the thickness of the washer 5*e*, an anchoring device may be provided, not shown in the drawings (technically equivalent to the anchoring device 1*b*), in which the intrados of the pin (such as the pin 5*b*) lies in the same plane as the intrados of the two wings (such as the two wings 4); in this case, the two wings are directly welded to said pin; in said anchoring device, the distance between the axis of said pin and the plane in which the wing axes are contained results to be minimum; this allows to reduce, with other conditions being equal, the stress condition of the anchoring device.

With reference to FIGS. 8, 9, 10, 11, 12 and 13, a connection system 30, on service life, is described for connecting construction elements suitable for use in the construction of buildings, according to the present invention, according to another embodiment; the connection system 30 connects a first construction element 31, which is technically equivalent to the first construction element 2, to a second construction element 32, which is technically equivalent to the second construction element 3; the connection system 30 comprises a retaining element 30*a*, made of steel, which is integral with the first construction element 31 and an anchoring device 30*b*, made of steel, which connects the retaining element 30*a* to the second construction element 32, and which thus connects the first construction element 31 to the second construction element 32. The anchoring device 30*b* comprises two wings 33 and a middle part 34 which connects the two wings 33 and is placed in contact with the retaining element 30*a*; the intrados of the two wings 33 lies in a same plane; the axes of the two wings 33 provide an angle therebetween with the vertex pointing the first construction element 31; it should be understood that the angle comprised between the axes of the two wings 33 is lower than ninety sexagesimal degrees, the bisector thereof being perpendicular to the outer surface of the first construction element 31 which surface faces the second construction element 32; each of the two wings 33 is connected to the second construction element 32; it should be understood that the two wings 33 are joined to the second construction element 32 by means of welds 35. The connection system 30 prevents, on service life, the relative displacements between the first construction element 31 and the second construction element 32 on the plane in which the axes of the two wings 33 lie. The middle part 34 comprises a joint area 34*a*, an anchoring-headed pin 34*b* which is partially threaded and joined to the joint area 34*a*, and a locking nut 34*c* screwed on the anchoring-headed pin 34*b*, and a washer 34*d*; the anchoring head of said anchoring-headed pin 34*b* is placed within the retaining element 30*a* and counteracts inner parts of said retaining element 30*a*; the locking nut 34*c*, that is screwed on the anchoring-headed pin 34*b*, counteracts outer parts of the retaining element 30*a* through the washer 34*d*. The anchoring-headed pin 34*b* has been welded to the joint area 34*a* in the same factory where the anchoring device 30*b* has been made. It should be understood that the anchoring-headed pin 34*b*, results to be locked by means of the locking nut 34*c* (and through the washer 34*d*), against the retaining element 30*a*; it should be understood that the relative displacements between the retaining element 30*a* and the anchoring device 30*b* result to be prevented on the plane where the axes of the two wings 33 lie (it should be understood that the relative displacements in the direction of the bisector of the angle comprised between the axes of the two wings 33 and in the direction perpendicular to said bisector are prevented).

The retaining element 30*a* is technically equivalent to the retaining element 1*a*; it should be noted that the retaining element 30*a* is not provided with caps (which are technically equivalent to the caps 8) and is not provided, upon casting of the concrete, with the front cap made of synthetic material as mentioned above (with reference to the retaining element 1*a*); in fact, before casting the concrete to make the first construction element 31, a sponge-like (or however flexible) synthetic material is inserted into the retaining element 30*a*, which material completely fills the inner space of the retaining element 30*a* and is then removed from the retaining element 30*a* after the first construction element 31 has been made.

In order to install the anchoring device 30*b*, the anchoring-headed pin 34*b* requires to be inserted into the retaining element 30*a*; subsequently, after the anchoring device 30*b* has been rotated by ninety sexagesimal degrees, the anchoring device 30*b* is placed in contact with the extrados of the second construction element 32, then the locking nut 34*c* is screwed until the latter, through the washer 34*d*, counteracts the retaining element 30*a*; the welds 35 are then carried out, which join the anchoring device 30*b* to the second construction element 32.

The behavior of the connection system 30 is technically equivalent to the behavior of the connection system 1.

With reference to FIGS. 14, 15, 16, 17, and 18, a connection system 40, on service life, is described for connecting construction elements suitable for use in the construction of buildings, according to the present invention, according to another embodiment; the connection system 40 connects a first construction element 41 (which is technically equivalent to the first construction element 2) to a second construction element 42, which consists of a reinforced concrete beam; the second construction element 42 comprises a steel plate 45, which is integral with the second construction element 42; the plate 45 is placed at the extrados of the second construction element 42 and is provided with anchoring stirrups (not shown in the drawings) which are embedded in the concrete of the second construction element 42; the connection system 40 comprises a retaining element 40*a*, made of steel, which is integral with the first construction element 41 and an anchoring device 40*b*, made of steel, which connects the retaining element 40*a* to the second construction element 42, and which thus connects the first construction element 41 to the second construction element 42. The anchoring device 40*b* comprises two wings 43 and a middle part 44 which connects the two wings 43 and which is placed in contact with the retaining element 40*a*; the intrados of the two wings 43 lies on a same plane; the axes of the two wings 43 provide an angle therebetween with the vertex pointing the first construction element 41; it should be understood that the angle comprised between the axes of the two wings 43 is lower than ninety sexagesimal degrees, the bisector thereof being perpendicular to the outer surface of the first construction element 41, which surface faces the second construction element 42; each of the two wings 43 is connected to the second construction element 42; it should be understood that the two wings 43 are joined to the second construction element 42 (at the plate 45) by means of welds 46; the connection system 40 prevents, on service life, the relative displacements between the first construction element 41 and the second construction element 42 on the plane in which the axes of the two wings 43 lie.

It should be noted that by the expression "plane in which the axes of the two wings lie", in case the axis of each wing is not rectilinear (such as in the case of the two wings 43) herein and in the claims below is meant the plane in which those parts of the axes (of the two wings) that are proximate to the retaining element integral with the first construction element lie.

The middle part 44 and the two wings 43 are made as one piece by means of fusion. The middle part 44 comprises a joint area 44*a*, having an increased thickness, provided with an unthreaded middle hole having the longitudinal axis parallel to the bisector of the angle comprised between the axes of the two wings 43, a block 44*b* having a threaded hole, and a screw 44*c* which is inserted within said unthreaded middle hole that is provided in the joint area 44*a*, and which is screwed within the threaded hole provided in the block 44*b*. The middle part 44 also comprises a spring 44*d*, which is technically equivalent to the spring 5*f*, which is joined to the block 44*b*. The block 44*b* is placed within the retaining element 40*a* and counteracts inner parts of the retaining element 40*a*; parts of the anchoring device 40*b*, and more precisely the front parts of the two wings 43 (i.e., those parts of the two wings 43 that are proximate to the block 44*b*), counteract outer parts of the retaining element 40*a*. Each of the two wings 43 has a widened area being arranged at the end (of said wing 43) which is welded to the second construction element 42; at said widened area, a hole 47 is provided. The screw 44*c* has an Allen head to reduce the overall dimensions of the head and thus to reduce the distance (vertically measured) between the axis of the screw 44*c* and the horizontal plane containing the axes of the two wings 43. The retaining element 40*a* is technically equivalent, and also very similar, to the retaining element 1*a*.

During the service life of the connection system 40, the resulting situation is as follows: the two wings 43 (of the anchoring device 40*b*) are joined by means of the welds 46 to the second construction element 42, and more precisely, to the plate 45 which is a part of the second construction element 42; the screw 44*c* is inserted into said unthreaded middle hole provided in the joint area 44*a*; the end of the screw 44*c* is screwed into the threaded hole provided in the block 44*b*; the block 44*b* is placed within the retaining element 40*a* and counteracts inner parts of the retaining element 40*a*; the head of the screw 44*c* counteracts the rear end of the joint area 44*a*. It should be understood that the front end (proximate to the retaining element 40*a*) of the joint area 44*a* is not in contact with the retaining element 40*a*; the front ends of the two wings 43 are in contact with the retaining element 40*a*; thereby, the contact between the anchoring device 40*b* and the retaining element 40*a* takes place in predetermined areas (which are the front ends of the two wings 43) that counteract the retaining element 40*a* proximate to the two webs of the retaining element 40*a*; it should be understood that said front ends of the two wings 43 placed in contact with the retaining element 40*a* are suitably shaped. It should be understood that said front ends of the two wings 43 are those parts of the anchoring device 40*b* which counteract outer parts of the retaining element 40*a*. Alternatively, according to a variant embodiment not illustrated in the drawings, the front end of the joint area also counteracts outer parts of the retaining element.

It should be understood that between the retaining element 40*a* and the anchoring device 40*b* the relative displacements are prevented on the plane in which the axes of the two wings 43 lie; according to the above, specific reference is made to the plane in which those parts of the axes (of the two wings 43) which are proximate to the retaining element 40*a* lie.

Figure 19:
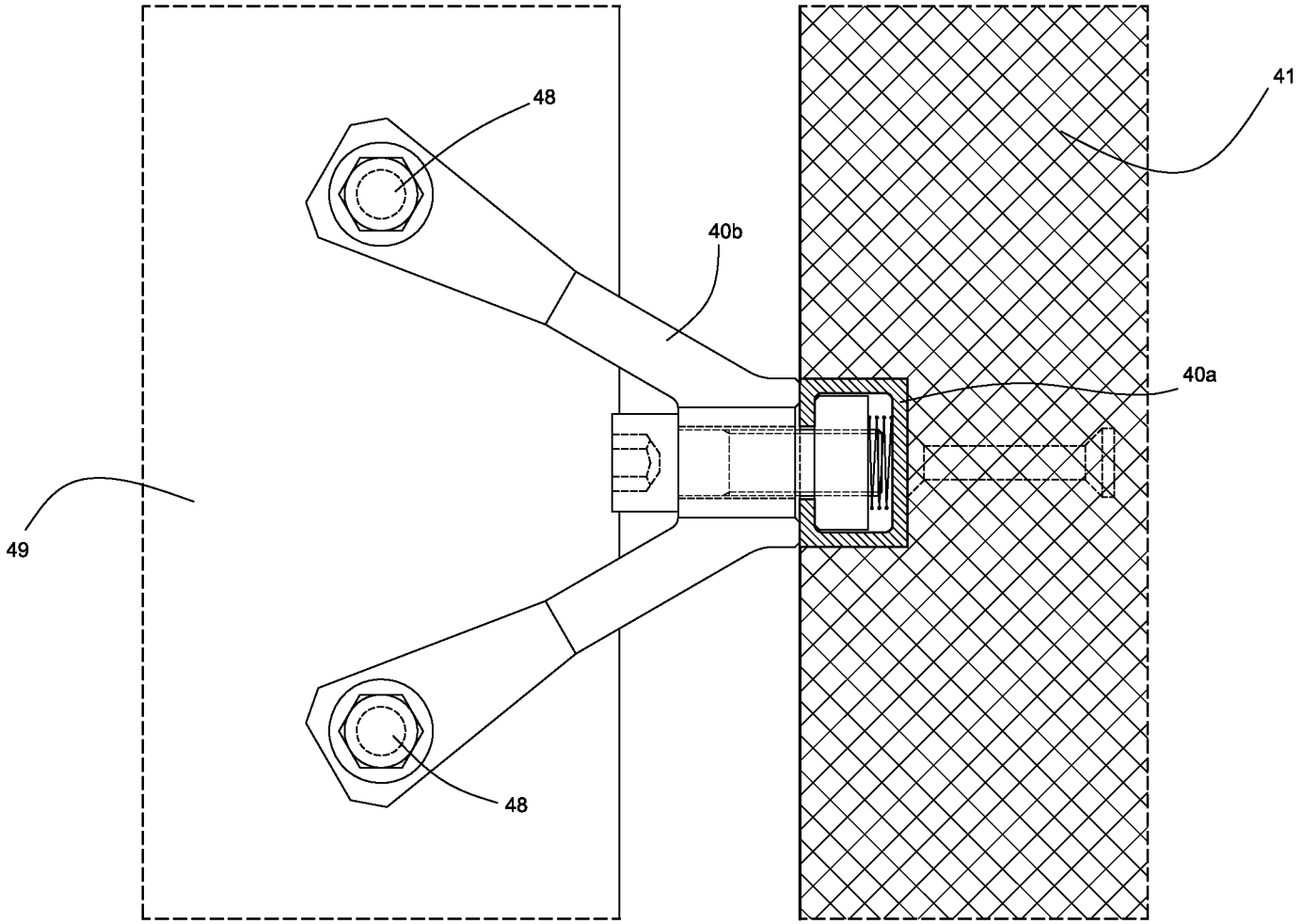
FIG. 19 is a top plan view of the connection system illustrated in FIGS. 14, 15, 16, 17 and 18, in the case where post-installed anchors are used for fixing the anchoring device.
Figure 21:
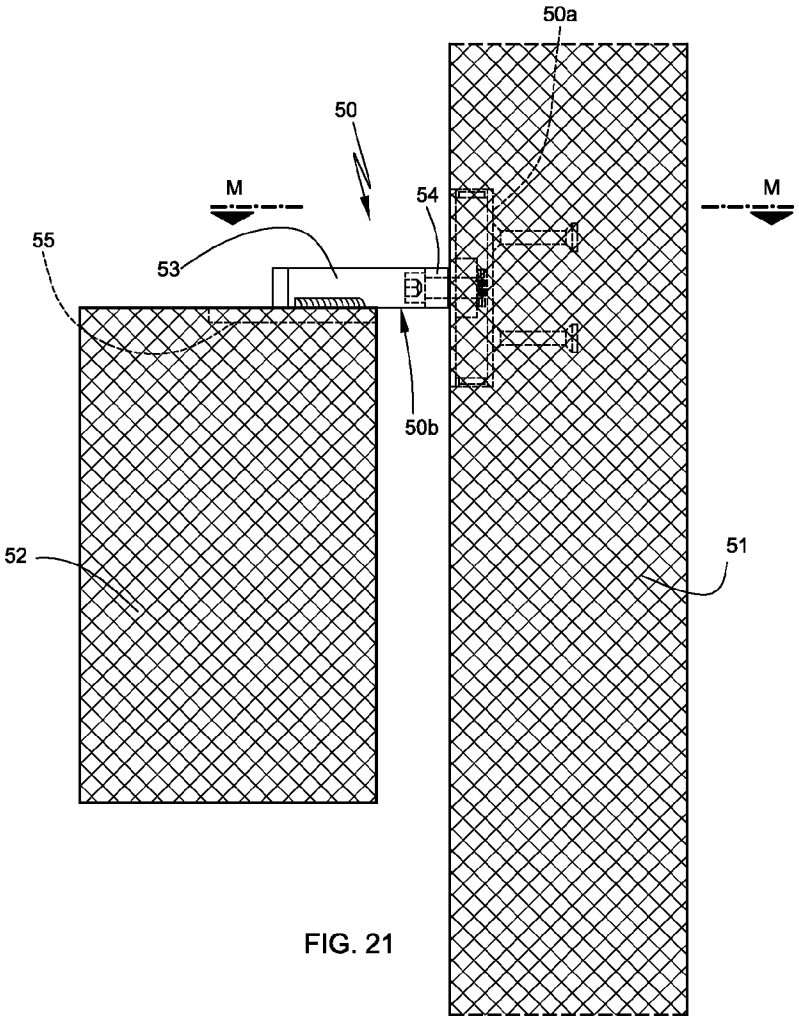
FIG. 21 is a side view, in the same scale as in FIG. 20, of the connection system illustrated in FIG. 20.
Figure 20:
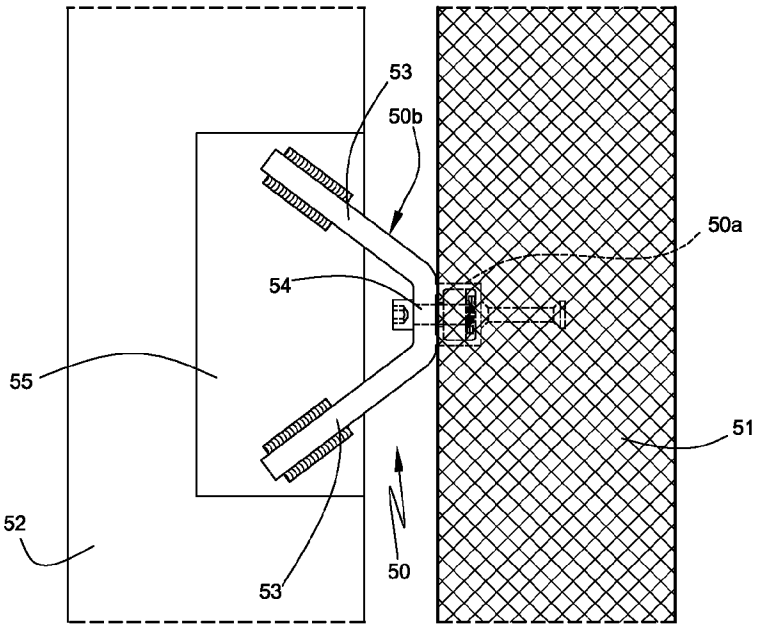
FIG. 20 is a top plan view of a connection system for connecting construction elements suitable for use in the construction of buildings, according to the present invention, according to a further embodiment thereof.
Figure 22:
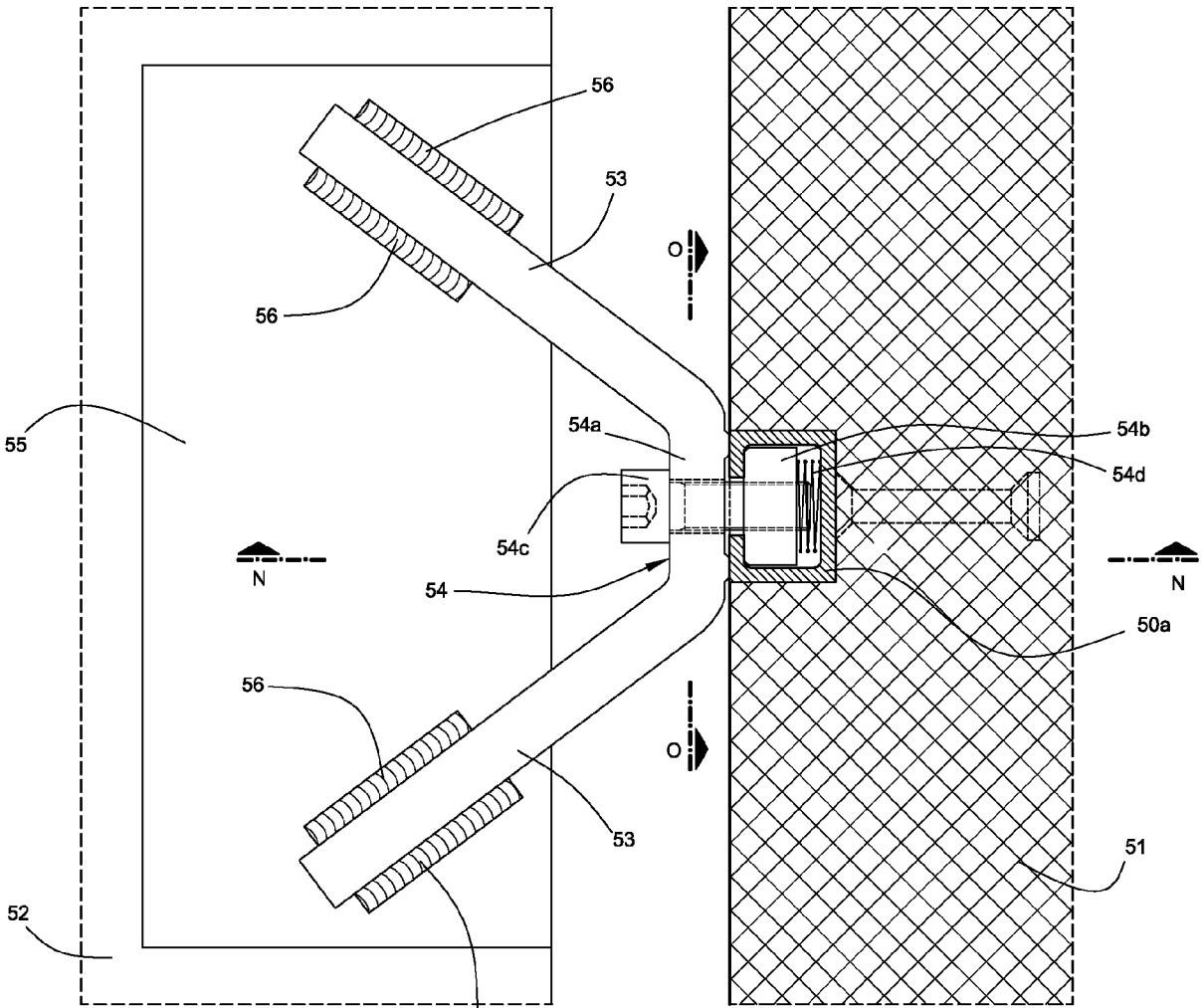
FIG. 22 shows, in greater scale than that in FIG. 20, the section according to the straight line M-M in FIG. 21.
Figure 24:
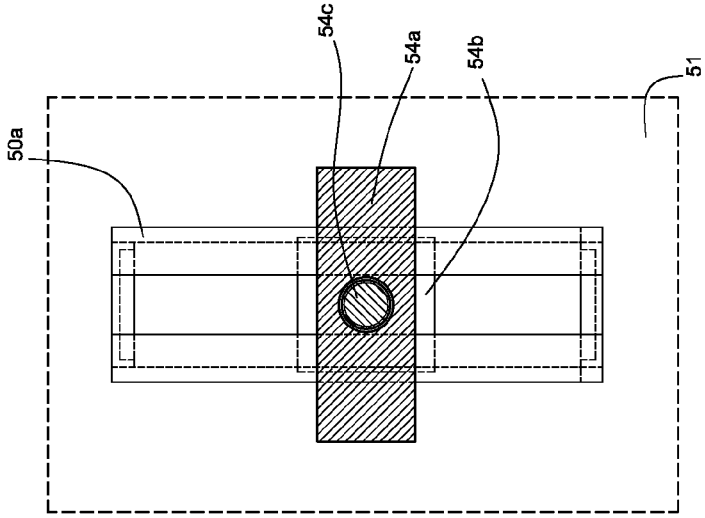
FIG. 24 shows, in the same scale as in FIG. 22, the section according to the straight line O-O in FIG. 22.
Figure 23:
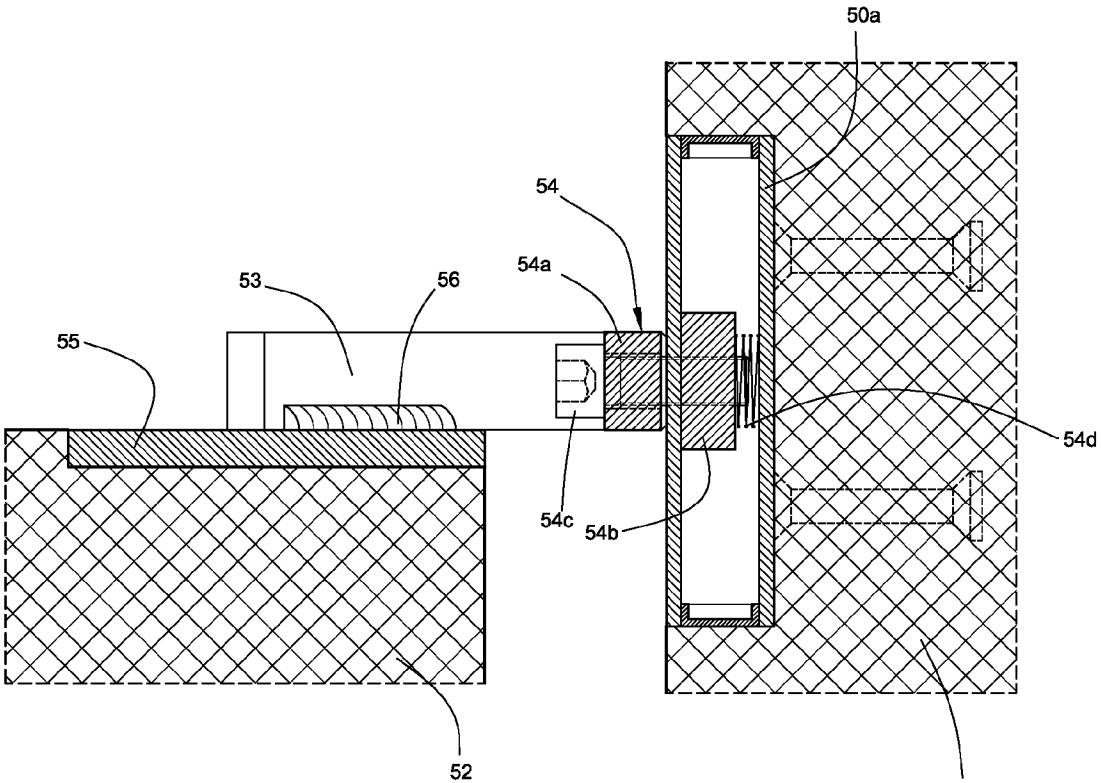
FIG. 23 shows, in the same scale as in FIG. 22, the section according to the straight line N-N in FIG. 22.
Figure 26:
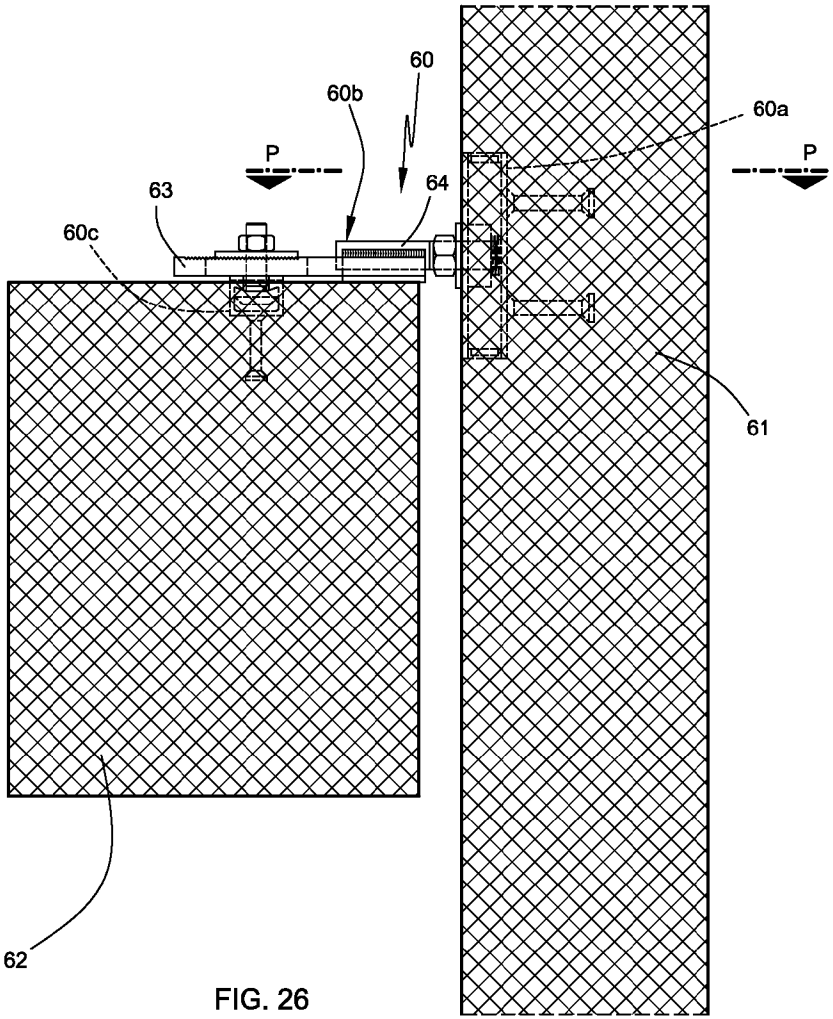
FIG. 26 is a side view, in the same scale as in FIG. 25, of the connection system illustrated in FIG. 25.
Figure 25:
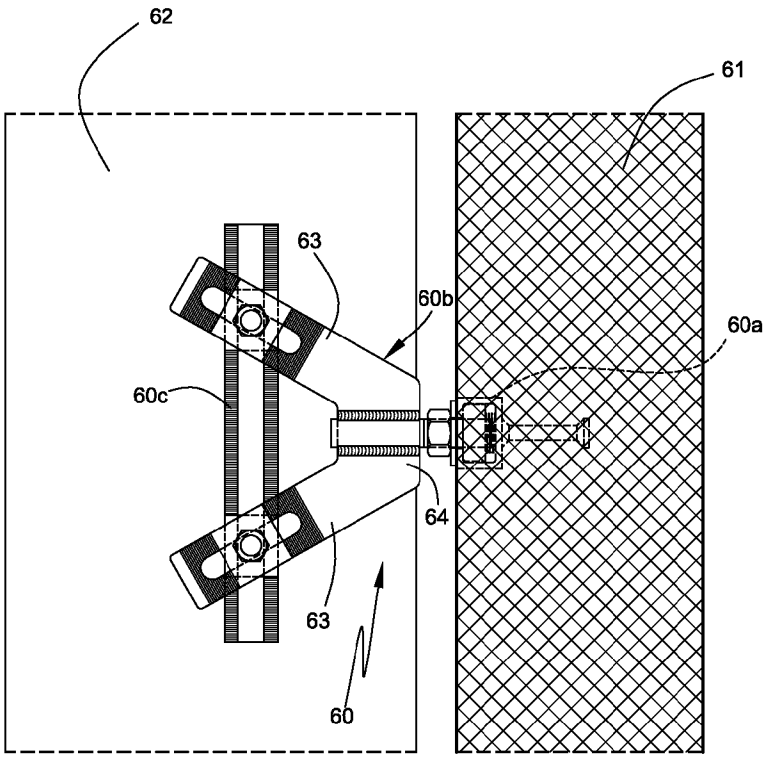
FIG. 25 is a top plan view of a connection system for connecting construction elements suitable for use in the construction of buildings, according to the present invention, according to a further embodiment thereof.
Figure 27:
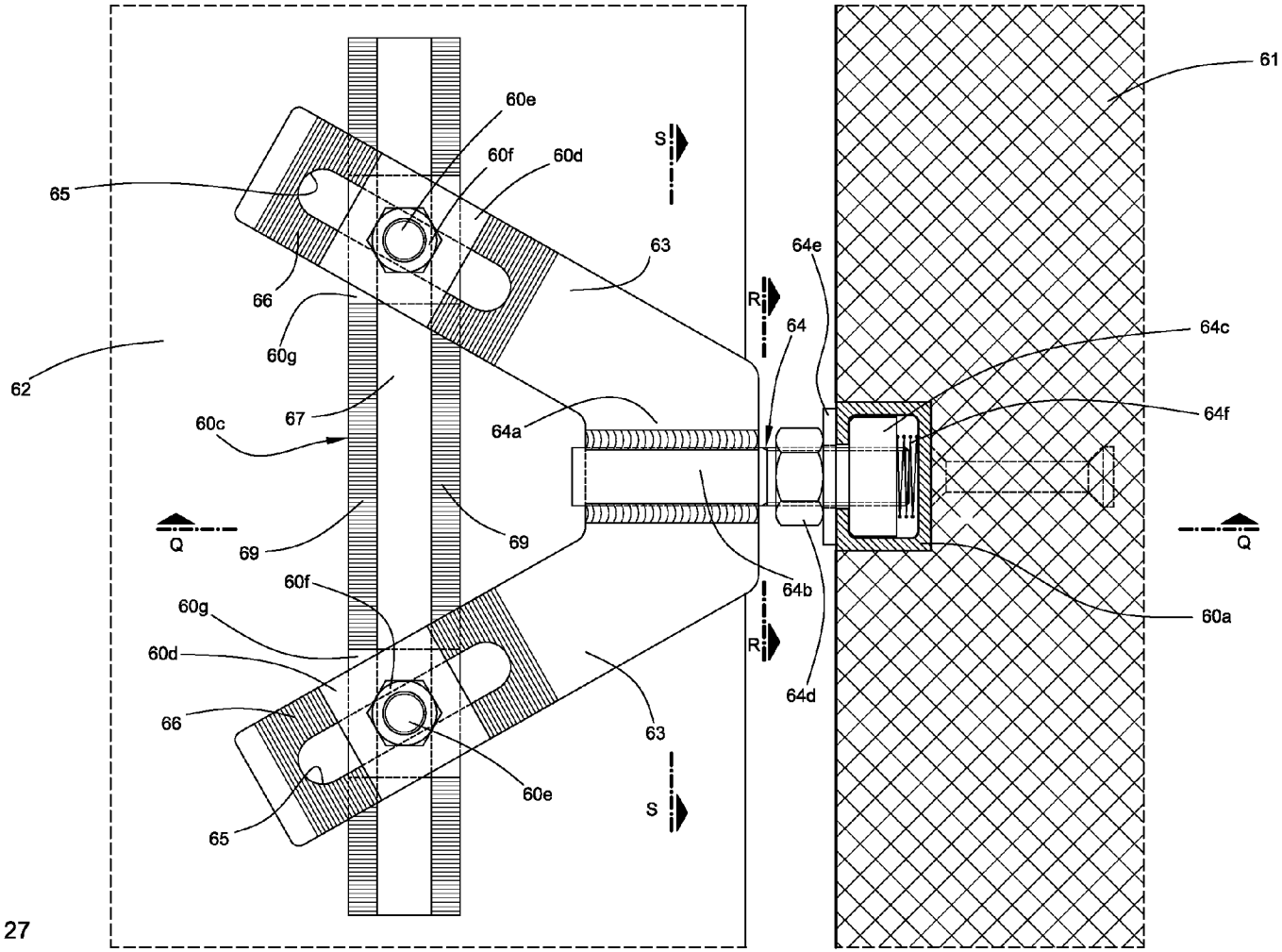
FIG. 27 shows, in greater scale than that in FIG. 25, the section according to the straight line P-P in FIG. 26.
Figure 28:
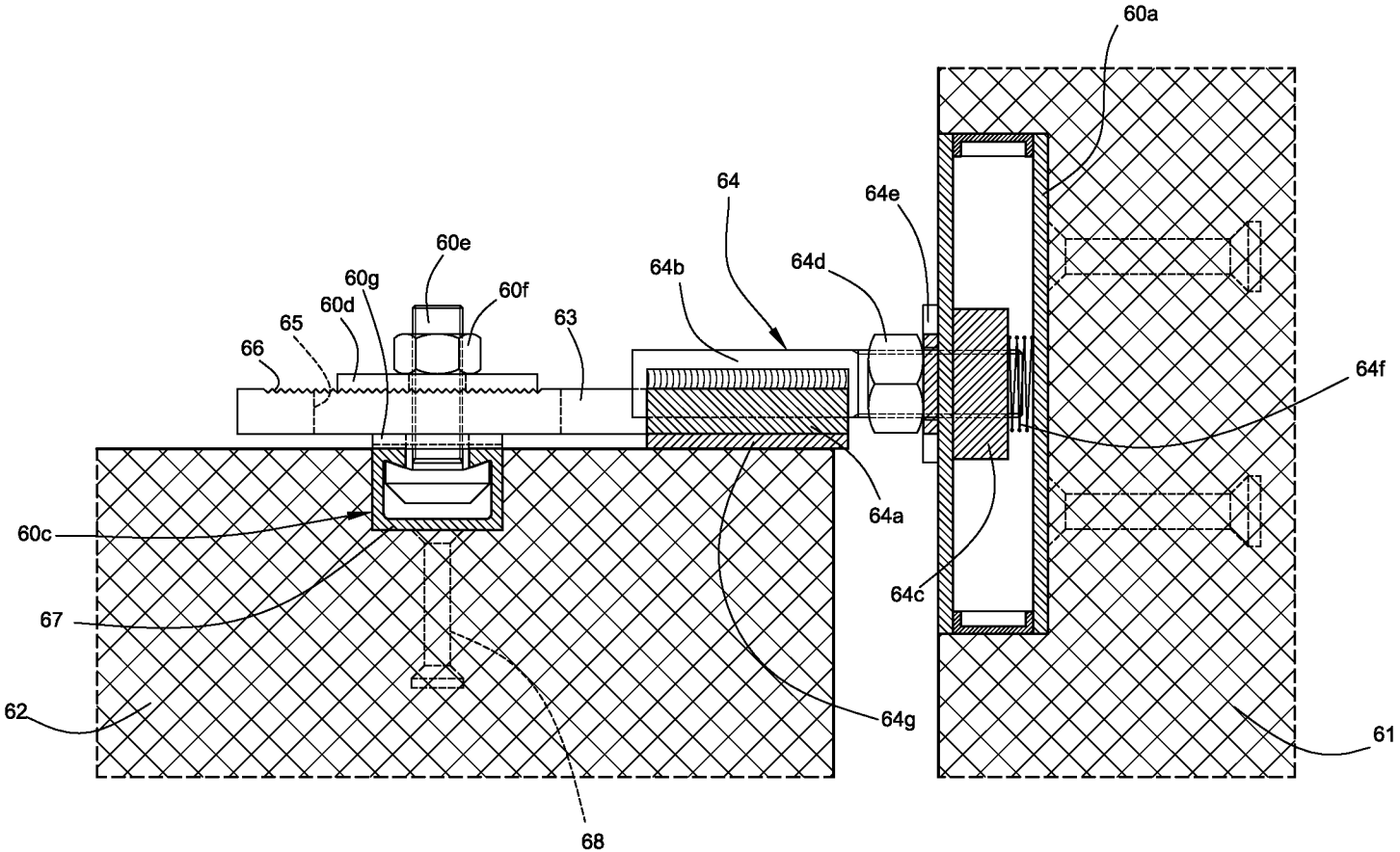
FIG. 28 shows, in the same scale as in FIG. 27, the section according to the straight line Q-Q in FIG. 27.
Figure 30:
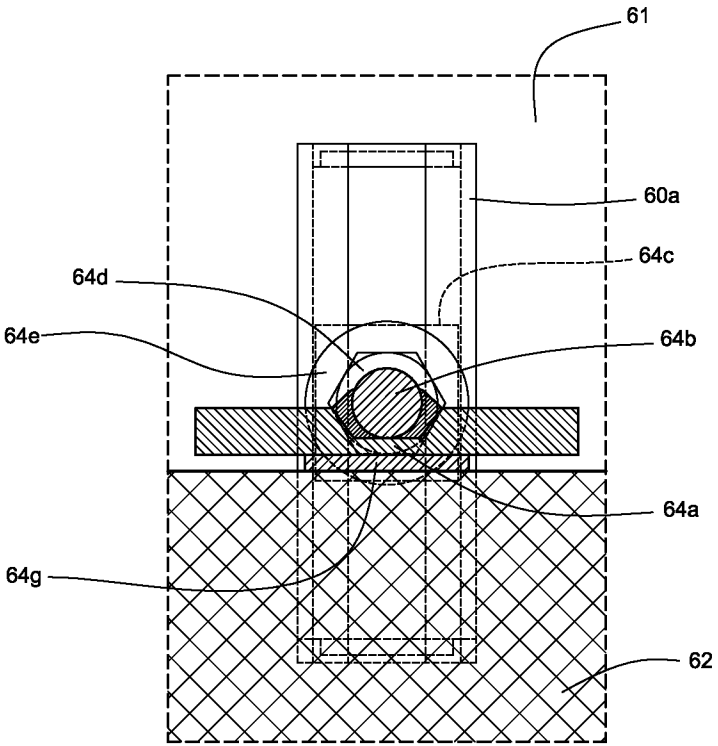
FIG. 30 shows, in the same scale as in FIG. 27, the section according to the straight line S-S in FIG. 27.
Figure 29:
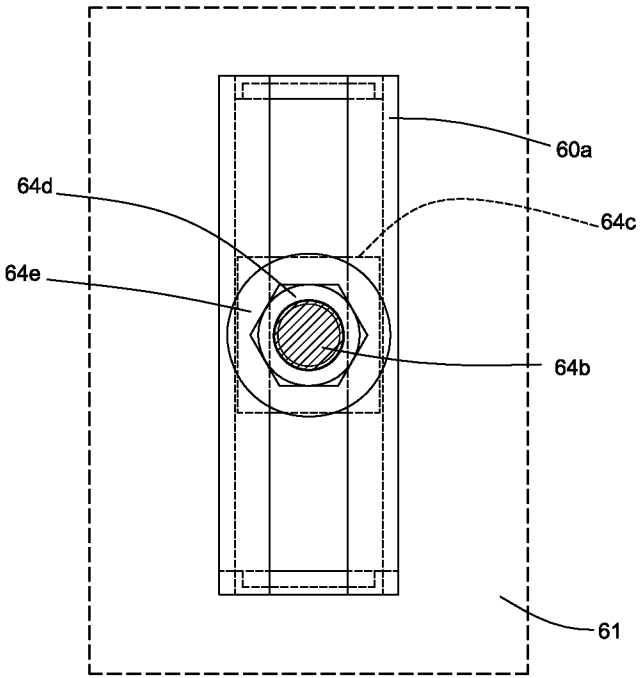
FIG. 29 shows, in the same scale as in FIG. 27, the section according to the straight line R-R in FIG. 27.

In order to install the anchoring device 40*b*, after the screw 44*c* has been inserted into said unthreaded middle hole provided in the joint area 44*a*, the anchoring device 40*b* is positioned in contact with the extrados of plate 45; the end of the screw 44*c* is then screwed in the block 44*b*, until the head of the screw 44*c* counteracts the rear end of the joint area 44*a*; the length of the screw 44*c* is such that, when the screw 44*c* is completely screwed, the anchoring device 40*b* results to be in contact with the retaining element 40*a*, and the end of the screw 44*c* results to be properly screwed within the block 44*b* and projects from the block 44*b* of a suitable small length. The two wings 43 are then made integral with the plate 45 by means of the welds 46. With reference to FIG. 19, the anchoring device 40*a* is illustrated which is connected to a second construction element 49 made of concrete (which differs from the second construction element 42 only in that the second construction element 49 is not provided with the plate 45) by means of two post-installed anchors 48; it should be understood that at each of the two wings 43 of the anchoring device 40*a* the hole 47 is provided for a post-installed anchor 48 to be inserted therein which is suitable to connect the anchoring device 40*a* to the second construction element 49; it should be understood that the anchoring device 40*a* is connected to the second construction element 49 by means of the two post-installed anchors 48 inserted within the holes 47 provided in the two wings 43 of the anchoring device 40*a*.

Using the post-installed anchors 48 may be an alternative technique for connecting the anchoring device 40*b* to the second construction element 49 (which is a prestressed concrete beam) other than the one described above which makes use of the welds 46.

According to another possible aspect, use may be made of the post-installed anchors 48 when, owing to mistakes or unexpected events, the plate 45 either results to be incorrectly positioned or is not provided. It should be understood that the connection between the anchoring device 40*b* and the second construction element 49 by means of the post-installed anchors 48 is advantageous in that the post-installed anchors 48, which are placed in the end area of the two wings 43, are positioned at a considerable distance from each other and also at a considerable distance from the edge of the second construction element 49, such as to be capable of taking advantage of the strength characteristics of the post-installed anchors 48; it should be understood that the value of the load-bearing capacity of the post-installed anchors 48 depends on, inter alia, the distance between the post-installed anchors 48 (which is advantageous if it is great) and on the distance of the post-installed anchors 48 from the edges of the second construction element 49 (which is advantageous if it is great), it being understood that the mutual distance between the post-installed anchors 48 and the distance of each post-installed anchor 48 from the edge of the second construction element 49 should be greater than the predetermined values resulting from the calculations relative to the post-installed anchors 48.

According to a possible variant embodiment, not illustrated in the drawings, an anchoring device may be provided, which is technically equivalent and also very similar to the anchoring device 40*b*, in which the middle part comprises a joint area having an increased thickness, a block (equal to the block 44*b*) having a threaded hole, and a screw (equal to the screw 44*c*); said joint area consists of a parallelepiped-shaped element provided with an unthreaded middle hole having the axis parallel to the bisector of the angle comprised between the axes of the two wings comprised within said anchoring device; said screw is inserted in said unthreaded middle hole and is screwed within the threaded hole provided in said block. It should be understood that, according to this variant embodiment, said two wings have been welded to said parallelepiped-shaped element upon manufacturing said anchoring device (in the factory).

With reference to FIGS. 20, 21, 22, 23, and 24, a connection system 50, on service life, is described for connecting construction elements suitable for use in the construction of buildings, according to the present invention, according to another embodiment; the connection system 50 connects a first construction element 51 (which is technically equivalent to the first construction element 2) to a second construction element 52 consisting of a reinforced concrete beam; the second construction element 52 comprises a steel plate 55, which is integral with the second construction element 52; the plate 55 is placed at the extrados of the second construction element 52 and is provided with anchoring stirrups (not shown in the drawings) which are embedded in the concrete of the second construction element 52; the connection system 50 comprises a retaining element 50*a*, made of steel, which is integral with the first construction element 51 and an anchoring device 50*b*, made of steel, which connects the retaining element 50*a* to the second construction element 52, and which thus connects the first construction element 51 to the second construction element 52. The anchoring device 50*b* comprises two wings 53 and a middle part 54 which connects the two wings 53 and is placed in contact with the retaining element 50*a*; the intrados of the two wings 53 lies on a same plane; the axes of the two wings 53 provide an angle therebetween with the vertex pointing the first construction element 51; it should be understood that the angle comprised between the axes of the two wings 53 is lower than ninety sexagesimal degrees, the bisector thereof being perpendicular to the outer surface of the first construction element 51, which surface faces the second construction element 52; each of the two wings 53 is connected to the second construction element 52; it should be understood that the two wings 53 are joined to the second construction element 52 (at the plate 55) by means of welds 56 (made at the construction site); the connection system 50 prevents, on service life, the relative displacements between the first construction element 51 and the second construction element 52 on the plane in which the axes of the two wings 53 lie. The middle part 54 and the two wings 53 are made as one piece. The middle part 54 comprises a joint area 54*a*, provided with an unthreaded middle hole with a longitudinal axis coincident to the bisector of the angle comprised between the axes of the two wings 53, a block 54*b* having a threaded hole, and a screw 54*c* which is inserted within said unthreaded middle hole that is provided in the joint area 54*a*, and which is screwed within the threaded hole provided in the block 54*b*. The middle part 54 also comprises a spring 54*d*, which is technically equivalent to the spring 5*f*, which is joined to the block 54*b*. The block 54*b* is placed within the retaining element 50*a* and counteracts inner parts of the retaining element 50*a*; parts of anchoring device 50*b* counteract outer parts of the retaining element 50*a*. The screw 54*c* has an Allen head in order to reduce the overall dimensions of the head. It should be understood that, in order to optimize the stress condition of the anchoring device 50*b*, the axis of the screw 54*c* coincides with the bisector of the angle comprised between the axes of the two wings 53. The retaining element 50*a* is technically equivalent, and also very similar, to the retaining element 1*a*.

The behavior of the connection system 50 is technically equivalent to the behavior of the connection system 40.

With reference to the FIGS. 25, 26, 27, 28, 29, 30, 31 and 32 a connection system 60, on service life, is described for connecting construction elements suitable for use in the construction of buildings, according to the present invention, according to another embodiment; the connection system 60 connects a first construction element 61 to a second construction element 62; the first construction element 61 consists of a reinforced concrete precast cladding panel, which is placed in the vertical position; the second construction element 62 consists of a prestressed concrete beam having horizontal axis; the connection system 60 comprises a retaining element 60*a* made of steel which is integral with the first construction element 61, an anchoring device 60*b* made of steel which connects the retaining element 60*a* to the second construction element 62, a further retaining element 60*c*, made of steel, which is integral with the second construction element 62 (it should be understood that the further retaining element 60*c* is placed at the extrados of the second construction element 62 and is partially embedded in the concrete of the second construction element 62), two upper toothed plates 60*d* made of steel each of which is provided with a middle hole, two anchoring-headed screws 60*e* made of steel, two nuts 60*f* made of steel each of which is screwed on the respective anchoring-headed screw 60*e*, and two lower toothed plates 60*g* made of steel, each of which is provided with a middle hole. It should be understood that the anchoring device 60*b* connects the retaining element 60*a* to the further retaining element 60*c*; the anchoring device 60*b* thus results to connect the first construction element 61 to the second construction element 62.

The anchoring device 60*b* comprises two wings 63 and a middle part 64 which connects the two wings 63 and is placed in contact with the retaining element 60*a*; the intrados of the two wings 63 lies on a same plane; the axes of the two wings 63 provide an angle therebetween with the vertex pointing the first construction element 61; it should be understood that the angle comprised between the axes of the two wings 63 is lower than ninety sexagesimal degrees, the bisector thereof being perpendicular to the outer surface of the first construction element 61, which surface faces the second construction element 62; the connection system 60 prevents, on service life, the relative displacements between the first construction element 61 and the second construction element 62 on the same plane where the axes of the two wings 63 lie. The middle part 64 comprises a joint area 64*a*, a pin 64*b* which is partially threaded and joined to the joint area 64*a*, a block 64*c* provided with a threaded hole in which the front end (and, i.e. the end proximate to the first construction element 61 (this end is inserted in the retaining element 60*a*)) of the pin 64*b* is screwed, a locking nut 64*d* screwed on the pin 64*b*, a washer 64*e* and an element acting as a shim 64*g* joined to the joint area 64*a*. The pin 64*b* has been welded to the joint area 64*a* in the same factory where the anchoring device 60*b* has been manufactured; the block 64*c* is placed within the retaining element 60*a* and counteracts inner parts of the retaining element 60*a*; the locking nut 64*d*, which is screwed on the pin 64*b* counteracts, through the washer 64*e*, outer parts of the retaining element 60*a*. The middle part 64 also comprises a spring 64*f* joined to the block 64*c* which is technically equivalent to the spring 5*f*. The element acting as a shim 64*g* is joined to, by means of welds (made in said factory) which are not indicated in the drawings, the intrados of the joint area 64*a* and has the same thickness of the two lower toothed plates 60*g*. The retaining element 60*a* is placed in the vertical position and is partially embedded in the concrete of the first construction element 61. The retaining element 60*a* is technically equivalent to the retaining element 1*a*. In the two upper toothed plates 60*d* the toothing is arranged at the intrados of the two upper toothed plates 60*d*. In the two lower toothed plates 60*g* the toothing is arranged at the intrados of the two lower toothed plates 60*g*.

The further retaining element 60*c* is placed in the horizontal position and is partially embedded in the concrete of the second construction element 62; the further retaining element 60*c* has the axis parallel to the axis of the second construction element 62. The further retaining element 60*c* comprises a section 67 (this section 67 is sometimes defined, in the prior art, as the "channel element") made of steel and connectors 68 integral with the section 67 which are embedded in the concrete of the second construction element 62; the steel section 67 is provided with toothing 69 perpendicular to the axis of the section 67, which toothing 69 is placed at the outer parts of the section 67, and i.e. placed at the extrados of said further retaining element 60*c*; the toothing 69 is provided throughout the length of the section 67. In each of the two wings 63, a slot 65 is provided; proximate to said slot 65 a toothing 66 is provided, which is placed at the extrados of said wing 63; the toothing 66 is perpendicular to the axis of said wing 63. Each of the two anchoring-headed screws 60*e* is inserted within the respective upper toothed plate 60*d*, within the respective slot 65 and within the respective lower toothed plate 60*g*; the anchoring head of said anchoring-headed screw 60*e* is anchored at the further retaining element 60*c*; the nut 60*f* screwed on the stem of said anchoring-headed screw 60*e* is tightened against said upper toothed plate 60*d*. It should be understood that each of the two upper toothed plates 60*d* is interposed between the respective nut 60*f* and the extrados of the respective wing 63; the toothing of said upper toothed plate 60*d* is inserted within the toothing 66 of said wing 63. It should be further understood that each of the two lower toothed plates 60*g* is interposed between the intrados of the respective wing 63 and the extrados of the further retaining element 60*c*; the toothing of said lower toothed plate 60*g* is inserted within the toothing 69 placed at said outer parts of the section 67. With reference to each of the two wings 63, the provision of the toothing 66, the respective upper toothed plate 60*d*, the provision of the toothing 69, and the respective lower toothed plate 60*g* result in that no relative translations of said wing 63 will occur relative to the further retaining element 60*c* in the direction of the axis of said wing 63 and in the direction of the axis of the further retaining element 60*c*. It should be understood that the toothing 66, the toothing 69 and the toothing provided in the two upper toothed plates 60*d* and in the two lower toothed plates 60*g*, have a very small size, which is also related to the hole-bolt clearance (particular reference is made to the clearance existing between the anchoring-headed screws 60*e* and the holes provided in the upper toothed plates 60*d* and in the lower toothed plates 60*g*, and to the width of the slots 65) and to the clearance, in the horizontal plane, between the middle part 64 (of the anchoring device 60*b*) and the retaining element 60*a*; it should be understood that the toothing 66, the toothing 69, the toothing provided in the two upper toothed plates 60*d* and the toothing provided in the two lower toothed plates 60*g* have such a size that, when the position of the first construction element 61 has been set, and thus when the position of the retaining element 60*a* has been set, and when the position of the second construction element 62 has been set, and thus when the position of the further retaining element 60*c* has been set, then they allow the proper positioning of the anchoring device 60*b* and the proper connection of the anchoring device 60*b* to the retaining element 60*a* and to the further retaining element 60*c*.

Generally, it should be understood that the connection system 60 allows connecting two construction elements without having to carry out welding on-site; thereby advantages can be obtained both in terms of easiness of the operations required for the assembly of the construction elements and, generally, also in terms of reliability.

Figure 32:
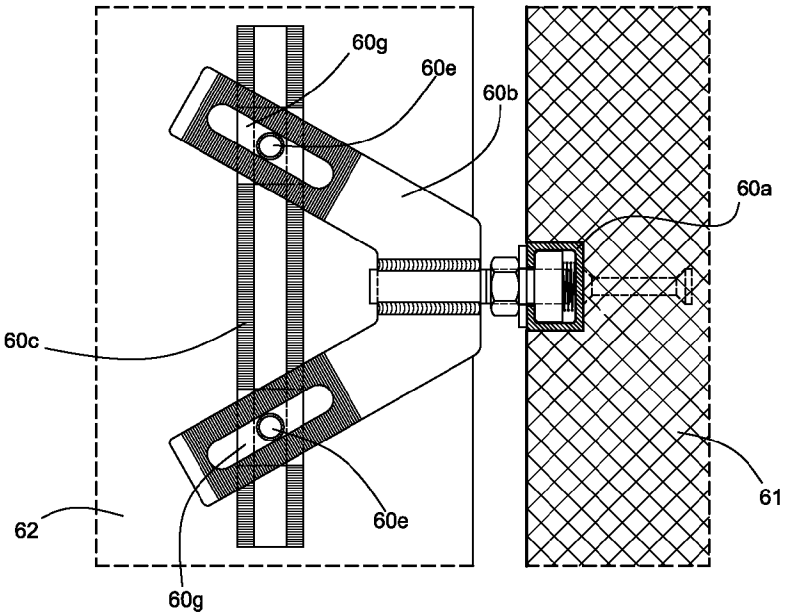
FIG. 32 illustrates, in the same scale as in FIG. 31, several parts of the connection system illustrate in FIGS. 25, 26, 27, 28, 29 and 30.
Figure 31:
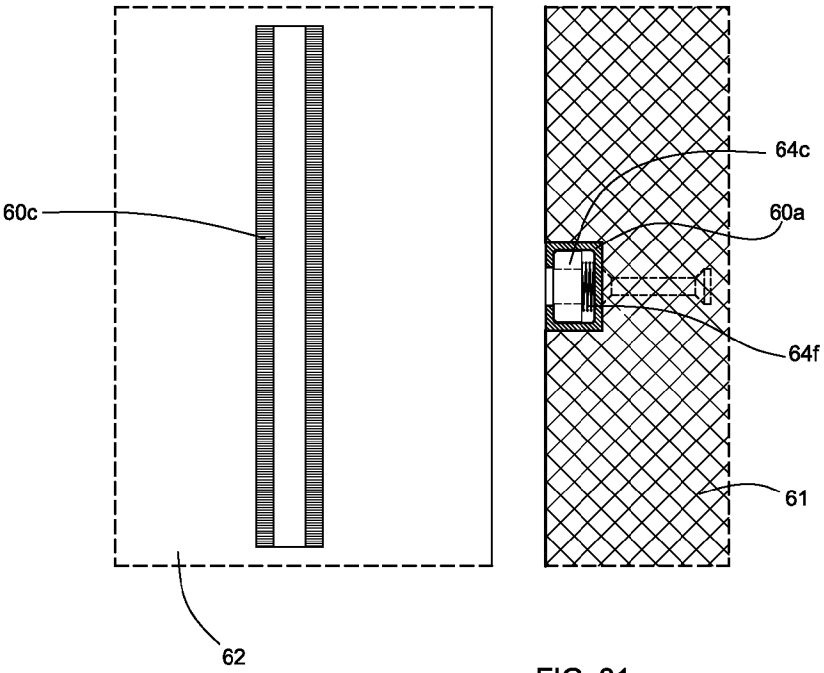
FIG. 31 illustrates, in greater scale than that in FIG. 25, several parts of the connection system illustrated in FIGS. 25, 26, 27, 28, 29 and 30.
Figure 34:
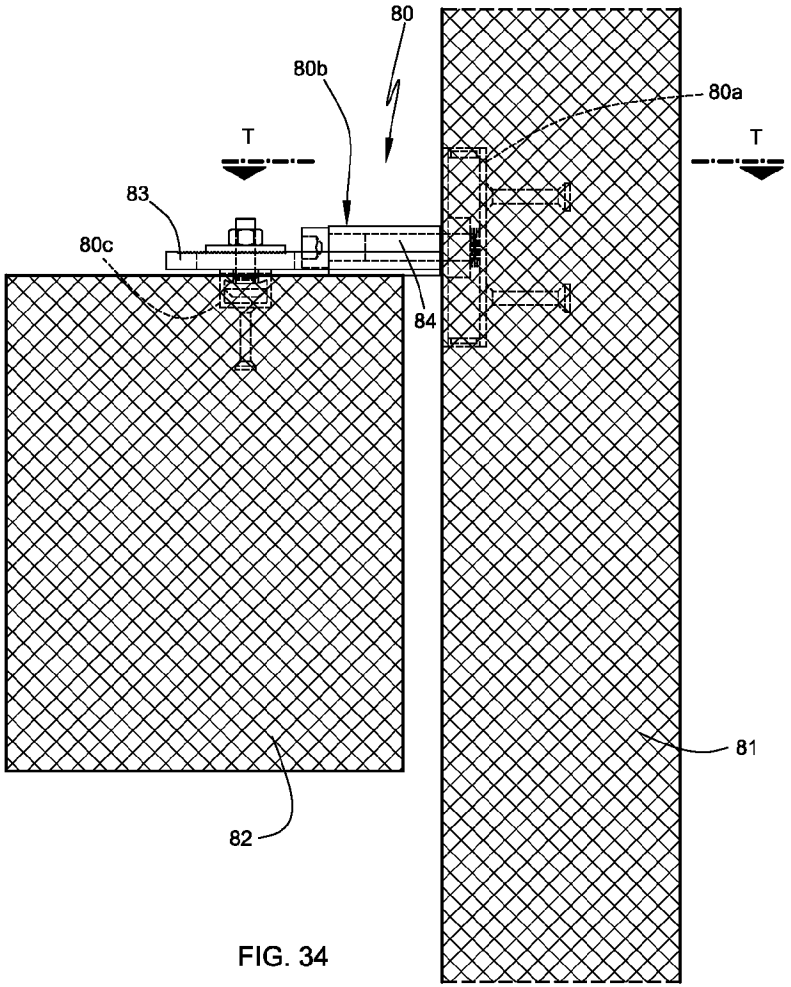
FIG. 34 is a side view, in the same scale as in FIG. 33, of the connection system illustrated in FIG. 33.
Figure 33:
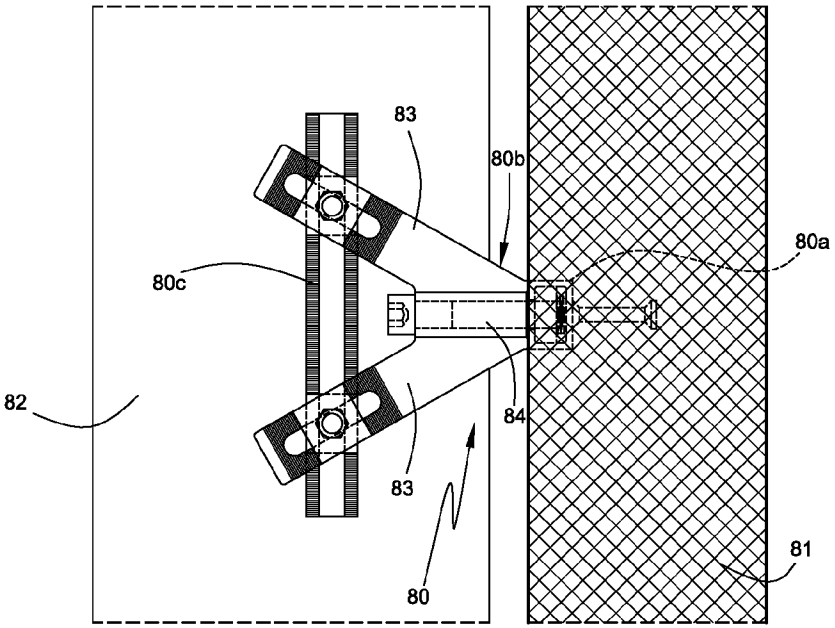
FIG. 33 is a top plan view of a connection system for connecting construction elements suitable for use in the construction of buildings, according to the present invention, according to a further embodiment thereof.
Figure 35:
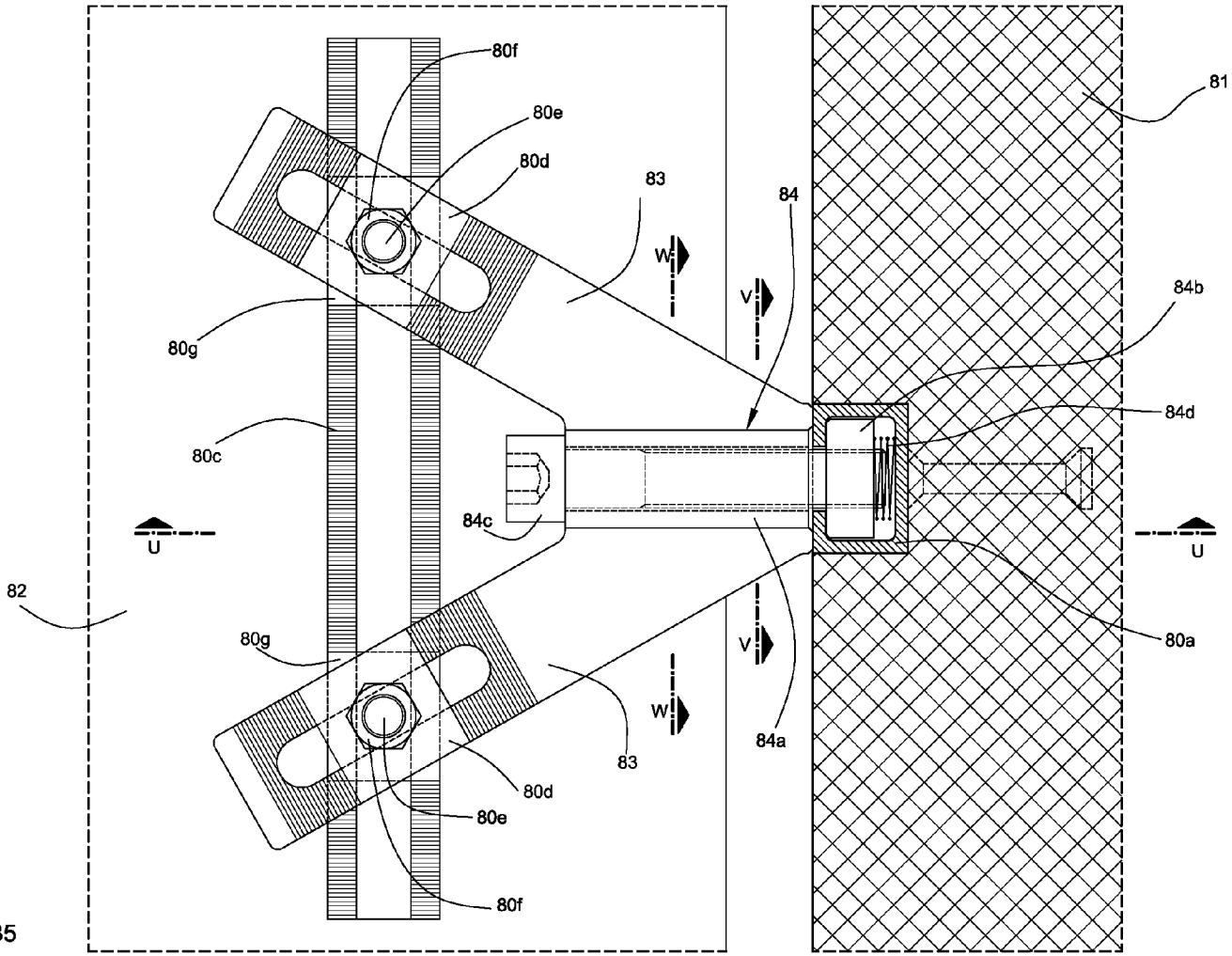
FIG. 35 shows, in greater scale than that in FIG. 33, the section according to the straight line T-T in FIG. 34.
Figure 36:
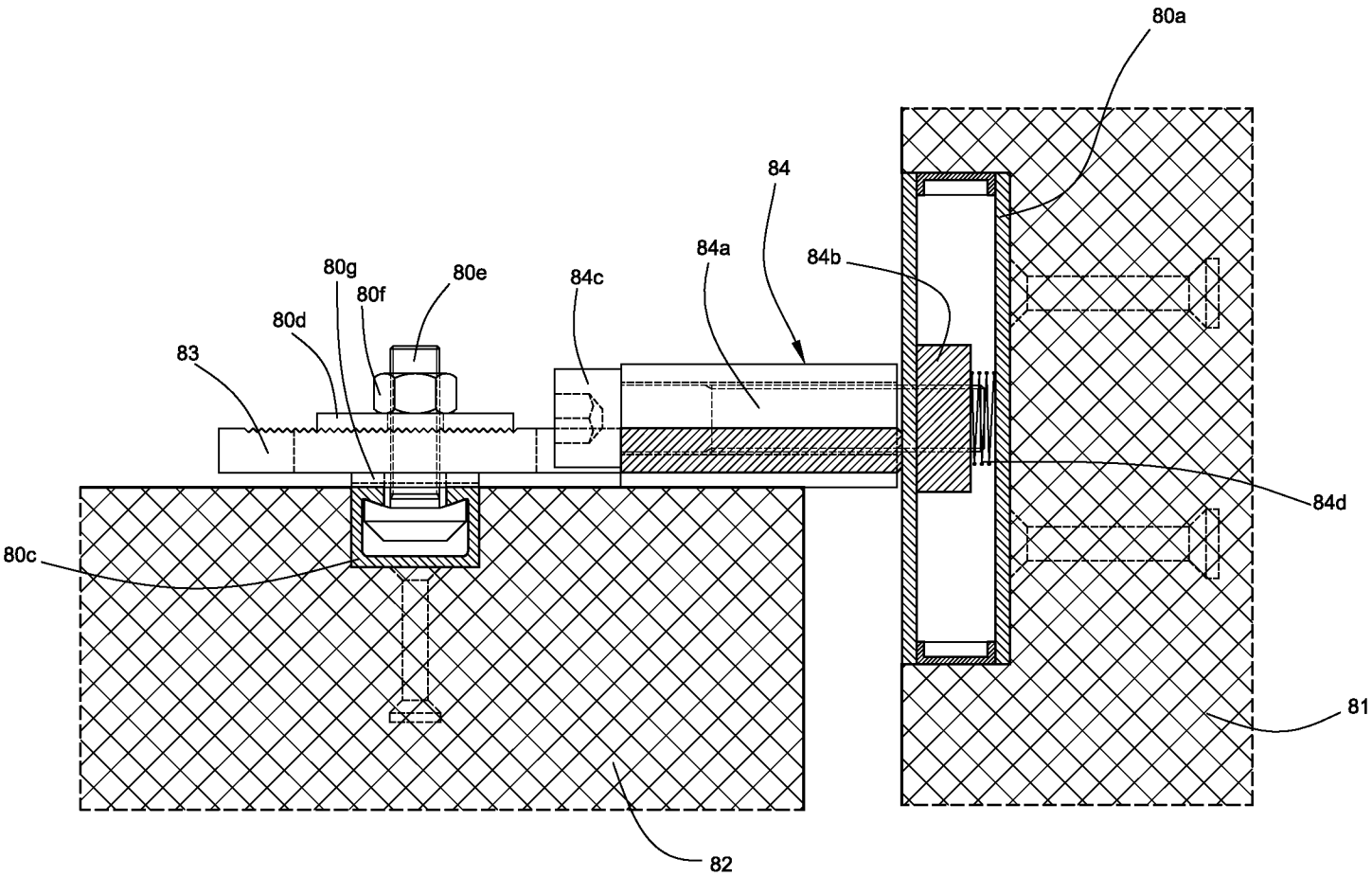
FIG. 36 shows, in the same scale as in FIG. 35, the section according to the straight line U-U in FIG. 35.
Figure 38:
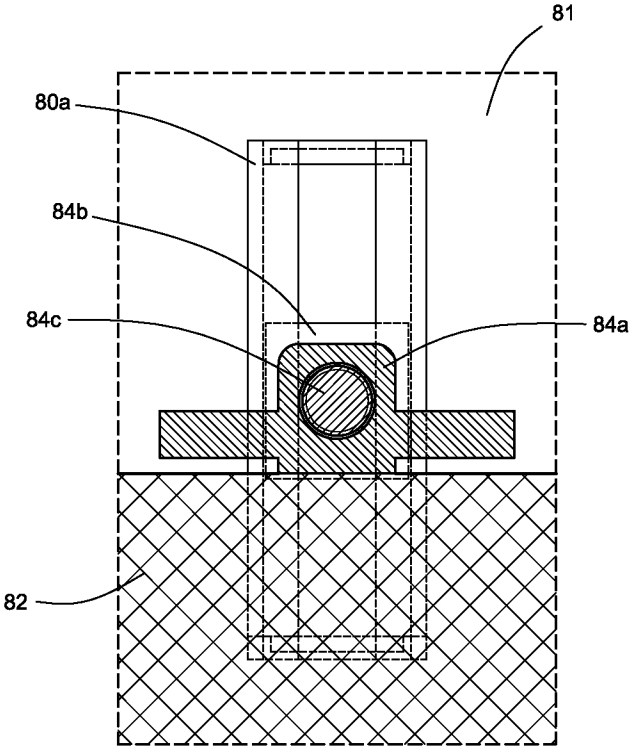
FIG. 38 shows, in the same scale as in FIG. 35, the section according to the straight line W-W in FIG. 35.
Figure 37:
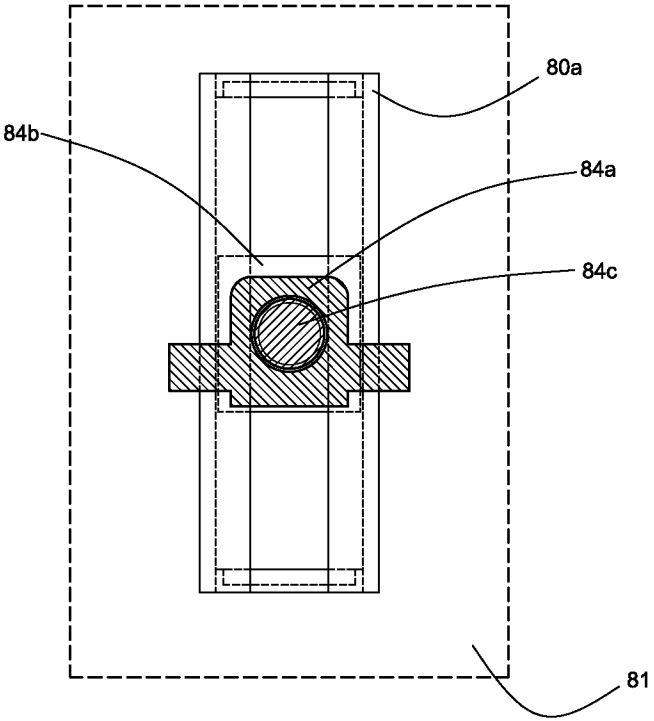
FIG. 37 shows, in the same scale as in FIG. 35, the section according to the straight line V-V in FIG. 35.

FIGS. 31 and 32 illustrate parts of the connection system 60 (with reference also to the operations of installing the anchoring device 60*b* on-site); particularly in FIG. 31 the retaining element 60*a*, the block 64*c*, the spring 64*f* and the further retaining element 60*c* are indicated; in FIG. 32 the retaining element 60*a*, the anchoring device 60*b*, the further retaining element 60*c*, the two lower toothed plates 60*g* and the two anchoring-headed screws 60*e* are indicated.

With reference to FIGS. 33, 34, 35, 36, 37 and 38, a connection system 80, on service life, is described for connecting construction elements suitable for use in the construction of buildings, according to the present invention, according to another embodiment; the connection system 80 connects a first construction element 81, technically equivalent to the first construction element 61, to a second construction element 82, technically equivalent to the second construction element 62; the connection system 80 comprises a retaining element 80*a* made of steel which is integral with the first construction element 81, an anchoring device 80*b* made of steel which connects the retaining element 80*a* to the second construction element 82, a further retaining element 80*c*, made of steel, being integral with the second construction element 82, two upper toothed plates 80*d* made of steel each of which is provided with a middle hole, two anchoring-headed screws 80*e* made of steel, two nuts 80*f* made of steel each of which is screwed to the respective anchoring-headed screw 80*e*, and two lower toothed plates 80*g* made of steel each of which is provided with a middle hole. It should be understood that the anchoring device 80*b* connects the retaining element 80*a* to the further retaining element 80*c*; the anchoring device 80*b* thus results to connect the first construction element 81 to the second construction element 82.

The anchoring device 80*b* comprises two wings 83 and a middle part 84 which connects the two wings 83 and is placed in contact with the retaining element 80*a*; the intrados of the two wings 83 lies on a same plane; the axes of the two wings 83 provide an angle therebetween with the vertex pointing the first construction element 81; it should be understood that the angle comprised between the axes of the two wings 83 is lower than ninety sexagesimal degrees, the bisector thereof being perpendicular to the outer surface of the first construction element 81, which surface faces the second construction element 82; the connection system 80 prevents, on service life, any relative displacements between the first construction element 81 and the second construction element 82 on the plane where the axes of the two wings 83 lie. The anchoring device 80*b* is technically equivalent to the anchoring device 60*b*. The middle part 84 and the two wings 83 are made as one piece by means of fusion. The middle part 84 comprises a joint area 84*a*, having an increased thickness, provided with an unthreaded hole with the longitudinal axis parallel to the bisector of the angle comprised between the axes of the two wings 83, a block 84*b* having a threaded hole, and a screw 84*c* which is inserted within said unthreaded hole provided in the joint area 84*a*, and which is screwed within the threaded hole provided in the block 84*b*; the middle part 84 also comprises a spring 84*d* joined to the block 84*b*; the spring 84*d* is technically equivalent to the spring 64*f*. The block 84*b* is placed within the retaining element 80*a* and counteracts inner parts of the retaining element 80*a*; parts of anchoring device 80*b* counteract outer parts of the retaining element 80*a*.

The screw 84*c* is provided with an Allen head. The two wings 83 are technically equivalent to the two wings 63. The retaining element 80*a* is technically equivalent, and also very similar, to the retaining element 60*a*.

The further retaining element 80*c* is technically equivalent, and also very similar, to the further retaining element 60*c*.

The behavior of the connection system 80 is technically equivalent to the behavior of the connection system 60.

According to a variant embodiment, not shown in the drawings, an anchoring device may be obtained, not shown in the drawings, (which is technically equivalent to the anchoring device 80*b* and also very similar thereto), in which the joint area (such as the joint area 84*a*) consists of a steel block in which an unthreaded hole is provided, the latter being equal to said unthreaded hole provided in the joint area 84*a*; to this steel block are welded the two wings, which are technically equivalent, and also very similar to the two wings 83; said anchoring device thus results to differ from the anchoring device 80*b* substantially in that said anchoring device is obtained by welding the wings to said steel block, whereas the joint area 84*a* and the two wings 83 of the anchoring device 80*b* are obtained as one piece, by means of fusion.

In each one of the connection systems according to the present invention, when the connection system has been installed, the locking nuts (such as the locking nuts 5*d*, 34*c*, 64*d*) or the screws (such as the screws 44*c*, 54*c*, 84*c*) should be prevented from accidental rotation; to the purpose, suitable means, such as for example spring washers, lock nuts, etc., may be used. It should be understood that said suitable means for preventing any accidental rotation of the locking nuts 5*d*, 34*c*, 64*d* relative to the pins 5*b*, 34*b*, 64*b*, or of the screws 44*c*, 54*c*, 84*c* relative to the joint areas 44*a*, 54*a*, 84*a* belonging to the anchoring devices 40*b*, 50*b*, 80*b* have not been indicated in the drawings. With reference to each one of the connection systems according to the present invention, several aspects of the behavior (from the static point of view) of the anchoring device (comprised in said connection system) will be described in greater detail below in order to point out the substantial difference between the behavior of said anchoring device and the behavior of an anchoring device made according to the prior art. Let us consider that the anchoring device (comprised in said connection system according to the present invention) is subjected to a force acting on the plane where the axes of the two wings of the anchoring device lie (or in a plane parallel and proximate thereto), perpendicularly to the bisector of the angle comprised between the axes of said two wings; let us further suppose that the two wings are joined to the second construction element by means of welds (made at the extrados of said second construction element) extending from (for example) half the length of each one of the two wings to the end of said wing. The stresses in the anchoring device mainly result from a normal (tensile and compression) stress behavior of the two wings, while the flexural behavior is minimized. It should be understood that the normal stress value in each one of the two wings varies very little (the angle between the axes of the two wings and the geometry of the middle part comprised in the anchoring device being fixed) as the length of the wings varies and particularly as the length of that part of the wings which is not welded to the second construction element varies, and hence as the distance between the first construction element and second construction element varies (reference is made to the values of the distance between the first construction element and the second construction element which are commonly used in the construction practice). This is a important advantage in that the anchoring devices made according to the prior art are such that, when a force is applied thereto which is contained on the plane of the anchoring device and is orthogonal to the axis of the anchoring device, the anchoring device results to be subjected to bending (other than to shear), the bending being strongly affected by the distance between the point of application of said force and the beginning of the part of anchoring device that results to be welded to the second construction element.

An anchoring device belonging to a connection system according to the present invention thus results to be particularly suitable for use even when the distance between the first construction element and the second construction element are considerable and/or when the production and erection tolerances of the first construction element and second construction element are considerable.

It should be understood that, during the design step of the anchoring device comprised in a connection system according to the present invention, by changing the angle comprised within the axes of the two wings and by changing the intersection point of said two axes, the stresses in the anchoring device, and particularly in the two wings will change, with the load condition being the same. It should be understood that, in particular circumstances, the bisector of the angle comprised between the axes of the two wings (which are part of the anchoring device) may be not perpendicular to the outer surface (which faces the second construction element) of the first construction element. It should be further understood that the angle comprised between the axes of the two wings (which are part of the anchoring device) may also be an angle of ninety sexagesimal degrees.

A connection system can be obtained according to the present invention which, in addition to the relative displacements between the first construction element and second construction element on the plane where the axes lie of the two wings of the anchoring device (comprised in said connection system), also prevents the relative displacements perpendicular to said plane between the same construction elements.

In an anchoring device comprised in a connection system according to the present invention at least parts of the anchoring device can be made (as the case may be) as one piece, for example, by means of fusion, or forging, or bending of metal elements, or they may be made by joining several elements by means of welds.

Each of the two wings of the anchoring device comprised in a connection system according to the present invention may be of either constant section or variable section. Each of the two wings of the anchoring device comprised in a connection system according to the present invention may be provided with a rectangular-, or "inverted T-", or "U"-section or may be provided with an otherwise-shaped section.

The anchoring device comprised in a connection system for connecting construction elements suitable for use in the construction of buildings, according to the present invention, can be made of steel, or stainless steel, or can be made using other metal alloys or also other materials, such as synthetic materials or composite materials.

It should be understood that the elements (such as the anchoring device, the retaining element, etc.) which are parts of connection system according to the present invention can be protected, for example, with zinc-electroplating or with particular painting cycles.

While reference has been made herein to first construction elements consisting of precast (cladding) panels made of reinforced concrete and to second construction elements consisting of beams, it is however understood that a connection system according to the present invention may be also used in other cases in the construction practice.

In case welds are not suitable or cannot be made on-site, either a connection system such as the connection systems 60, 80 results to be advantageously used, or alternatively a connection system (such as the connection system 40) providing for the use of post-installed anchors (such as the post-installed anchors 48) for connecting the anchoring device to the second construction element results to be advantageously used.

With reference to connection systems according to the present invention, such as the connection systems 60, 80, it should be understood that, in case the distance between the two anchoring-headed screws (such as the anchoring-headed screws 60*e*, 80*e*) which are inserted in the further retaining element is considerable, it may be advantageous if the further retaining element is split in two parts, which are then joined using a metal spacer.

It should be understood that the anchoring device comprised in a connection system according to the present invention can be provided with holes arranged at the ends of the wings (reference is made to the ends proximate to the second construction element), such as in the case of the anchoring device 40*b*, or with slots (such as the slots 65), such as in the case of the anchoring device 60*b* and of the anchoring device 80*b*, so that said anchoring device can be connected to the second construction element by means of post-installed anchors (such as the post-installed anchors 48). It should be understood that, in order to connect the two wings to the second construction element, the holes for the post-installed anchors are arranged at a considerable distance from each other (as a function of the size of the wings and the angle therebetween) such as to be capable of suitably using the strength characteristics of the post-installed anchors; it should be understood, generally, that the values of the load-bearing capacity of the post-installed anchors depend on, inter alia, the distance between the post-installed anchors (which is advantageous if it is great) and the distance between the post-installed anchors and the edges of the construction element in which the post-installed anchors are inserted (which is advantageous if it is great). The fact that post-installed anchors (being arranged in a suitable position) can be used for connecting the anchoring device to the second construction element is an indisputable advantage over the anchoring devices according to the prior art. The retaining element comprised in a connection system (for connecting construction elements suitable for use in the construction of buildings) according to the present invention may be, generally, a channel element (comprising a section, such as the sections 6, and connectors, such as the connectors 7) typical of European production (according to the prior art) or can be a slotted insert typical of American production (according to the prior art) or may be any other element (integral to the first construction element) to which the anchoring device which is comprised in said connection system according to the present invention can be effectively connected.

It should be understood that the connection systems 1, 30, 40, 50, 60, 80 can be used both in cases where a predetermined distance between the first construction element and the second construction element is provided, and also in case the value of this distance is substantially null.

In the connection systems 1, 40, 50, 60, 80 illustrated herein, the spring 5*f*, 44*d*, 54*d*, 64*f*, 84*d* can be replaced with other technically equivalent elastic elements.

An advantage of the present invention is that, with the geometry of the middle part belonging to the anchoring device being the same, the normal stresses in the two wings of the anchoring device (which are the main stresses) vary very little as the distance varies (reference is made to those values of the distance between the first construction element and the second construction element which are commonly used in the construction practice) between the first construction element and the second construction element (which are connected by means of said connection system); the anchoring device according to the present invention can thus be used also when said distance is great.

Another advantage of the present invention is that the relative displacements between the first construction element and the second construction element can be prevented on the plane where the axes of the two wings of the anchoring device lie without carrying out any welding, such as in the case of the connection systems 60, 80.

A further advantage of the present invention is that the anchoring device (such as in the case of the anchoring devices 40*b*, 60*b*, 80*b*) may be such as to be connectable to the second construction element also using post-installed anchors.

A further advantage of the present invention is that it is very easy to install.

The invention claimed is:

1. A connection system for connecting construction elements suitable for transportation to and use in the construction of buildings, comprising:

a retaining element (1*a*) integral with a first construction element (2), the first construction element being a reinforced concrete precast cladding panel; and an anchoring device (1*b*) connecting said retaining element to a second construction element (3), the second construction element being a construction beam, wherein, said anchoring device comprises two wings (4) connected by a middle part (5), each of the two wings connected to the second construction element (3), the two wings each defining an arch with an introdos, the intrados of the two wings (4) lay on a common first plane, axes of the two wings (4) lying on the first plane and providing an angle therebetween with a vertex pointing to the first construction element (2), the middle part (5) comprising i) a joint area (5*a*), ii) an at least partially treaded pin (5*b*) joined to the joint area, iii) a block (5*c*) provided with a threaded hole, a front end of the pin (5*b*) screwed into the threaded hole of the block, and iv) a locking nut (5*d*) screwed on the pin (5*b*, 64*b*), wherein the block (5*c*) is located within the retaining element bearing against inner parts of the retaining element counteracting the inner parts in a first direction, and the locking nut (5*d*) is screwed on the pin (5*b*) against outer parts of the retaining element countering the outer parts of the retaining element in a second direction opposite the first direction so that, during a service life thereof, relative displacements between the first construction element (2) and second construction element (3) on the first plane where the axes of the two wings (4) lie are prevented.

2. The connection system according to claim 1, wherein the angle comprised between the axes of the two wings (4) comprised in the anchoring device (1*b*) is lower than or equal to ninety sexagesimal degrees, the bisector thereof being perpendicular to the outer surface of the first construction element (2), which surface faces the second construction element (3), and the joint area comprises a weld joining the pin to the joint area.

3. The connection system according to claim 1, further comprising:

welds (9) that join each of the two wings (4) of the anchoring device (1*b*) to said second construction element (3).

4. The connection system according to claim 1, characterized in that it comprises, in addition to a retaining element (60*a*, 80*a*) being integral with the first construction element (61, 81) and to an anchoring device (60*b*, 80*b*), also a further retaining element (60*c*, 80*c*) being integral with the second construction element (62, 82), two upper toothed plates (60*d*, 80*d*) each of which is provided with a middle hole, two anchoring-headed screws (60*e*, 80*e*), two nuts (60*f*, 80*f*) each of which is screwed to the respective anchoring-headed screw (60*e*, 80*e*), and two lower toothed plates (60*g*, 80*g*) each of which is provided with a middle hole; the anchoring device (60*b*, 80*b*) comprises two wings (63, 83) and a middle part (64, 84); said further retaining element (60*c*, 80*c*) comprises, inter alia, a section (67) provided with toothing (69) that is perpendicular to the axis of said section, which is placed at the outer parts of said section; in each of the two wings (63, 83) a slot (65) is provided; proximate to said slot (65) toothing (66) is provided which is placed at the extrados of said wing (63, 83); the toothing (66) is perpendicular to the axis of said wing (63, 83); each of the two anchoring-headed screws (60*e*, 80*e*) is inserted within the respective upper toothed plate (60*d*, 80*d*), within the respective slot (65) and within the respective lower toothed plate (60*g*, 80*g*); the anchoring head of said anchoring-headed screw (60*e*, 80*e*) is anchored at said further retaining element (60*c*, 80*c*); the nut (60*f*, 80*f*) screwed on the stem of said anchoring-headed screw (60*e*, 80*e*) is tightened to said upper toothed plate (60*d*, 80*d*);

each of the two upper toothed plates (60*d*, 80*d*) is interposed between the respective nut (60*f*, 80*f*) and the extrados of the respective wing (63, 83); the toothing of said upper toothed plate (60*d*, 80*d*) is inserted within the toothing (66) of said wing (63, 83); each of said two lower toothed plates (60*g*, 80*g*) is interposed between the intrados of the respective wing (63, 83) and the extrados of the further retaining element (60*c*, 80*c*); the toothing of said lower toothed plate (60*g*, 80*g*) is inserted within the toothing (69) that is placed at said outer parts of said section (67).

5. The connection system according to claim 1, characterized in that at least one hole (47) is provided at each of the two wings (43) of the anchoring device (40*a*) for a post-installed anchor (48) to be inserted therein, the post-installed anchor being suitable to connect the anchoring device (40*a*) to the second construction element (49); the anchoring device (40*a*) being connected to the second concrete construction element (49) by means of post-installed anchors (48) being inserted within the holes (47) that are provided in the two wings (43) of said anchoring device.

6. The connection system according to claim 1, wherein, in addition to the relative displacements between the first construction element and second construction element on the plane where the axes lie of the two wings of the anchoring device comprised in said connection system, relative displacements perpendicular to said plane between the same construction elements is also prevented.

7. The connection system according to claim 1, wherein, the retaining element (1*a*) is partially embedded within concrete of said first construction element.

8. The connection system according to claim 1, further comprising:

welds (9) that join each of the two wings (4) of the anchoring device (1*b*) to said second construction element (3), wherein, the second construction element is a steel beam, a longitudinal axis of the steel beam being horizontal, a longitudinal axis of the reinforced concrete precast cladding panel being vertical, and relative displacements are prevented in a direction of a bisector of the angle comprised between the axes of the two wings and a the direction perpendicular to said bisector.

9. The connection system according to claim 1, further comprising:

a spring (5*f*) located between the block (5*c*) and an inner wall of the retaining element, the spring counteracting both the block (5*c*) and inside parts of the retaining element (1*a*).

10. The connection system according to claim 1, wherein, the retaining element (1*a*) comprises a steel section (6) defining a channel element, a connector (7) integral with the section (6) and embedded in concrete of the first construction element (2), and two caps (8) closing the section (6) at the ends thereof.

11. The connection system according to claim 9, wherein, the retaining element (1*a*) comprises a steel section (6) defining a channel element, two connectors (7) integral with the section (6) and embedded in concrete of the first construction element (2), and two caps (8) closing the section (6) at the ends thereof, and the two connectors are integral with the inner wall of the retaining element.

12. The connection system according to claim 1, wherein, the joint area contacts an exterior surface of the construction beam.

13. A connection system for connecting construction elements suitable for transportation to and use in the construction of buildings, comprising:

a retaining element (1*a*) integral with a first construction element (2), the first construction element being a reinforced concrete precast cladding panel, the retaining element comprising an inside rebate (6*a*) and an outside rebate (6*b*); and an anchoring device (1*b*) connecting said retaining element to a second construction element (3), the second construction element being a construction beam, wherein, said anchoring device comprises two wings (4) connected by a middle part (5), each of the two wings connected to the second construction element (3), the two wings each defining an arch with an introdos, the intrados of the two wings (4) lay on a common first plane, axes of the two wings (4) lying on the first plane and providing an angle therebetween with a vertex pointing to the first construction element (2), the middle part (5) comprising i) a joint area (5*a*), ii) a partially threaded pin (5*b*) joined to the joint area by a weld, iii) a block (5*c*) provided with a threaded hole, a front end of the pin (5*b*) screwed into the threaded hole of the block, and iv) a locking nut (5*d*) screwed on the pin (5*b*), wherein the block (5*c*) is located within the retaining element bearing against the inside rebate (6*a*) counteracting the inside rebate in a first direction, and the locking nut (5*d*) is screwed on the pin (5*b*) against the outside rebate (6*b*) countering the outside rebate in a second direction opposite the first direction so that, during a service life thereof, relative displacements between the first construction element (2) and second construction element (3) on the first plane where the axes of the two wings (4) lie are prevented.

14. The connection system according to claim 13, further comprising:

a spring (5*f*) located between the block (5*c*) and an inner wall of the retaining element, the spring counteracting both the block (5*c*) and inside rebate (6*a*) of the retaining element (1*a*), wherein, the retaining element (1*a*) comprises a steel section (6) defining a channel element, a connector (7) integral with the section (6) and embedded in concrete of the first construction element (2), and two caps (8) closing the section (6) at the ends thereof, and the section (6) includes two of said inner rebate (6*a*), two of said outer rebate (6*b*), and two side rebates (6*c*), the spring (5*f*) pushes the block (5*c*) against the two inner rebates (6*a*), the two connectors are integral with the inner wall of the retaining element, and the joint area contacts an exterior surface of the construction beam.

15. A connection system for connecting construction elements suitable for transportation to and use in the construction of buildings, comprising:

a retaining element (1*a*) integral with a first construction element (2), the first construction element being a reinforced concrete precast cladding panel, the retaining element having an opening surrounded by a exterior-facing part with an inside rebate (6*a*) and an outside rebate (6*b*), the retaining element being embedded within concrete of said first construction element; and an anchoring device (1*b*) connecting said retaining element to a second construction element (3), the second construction element being a construction beam, wherein, said anchoring device comprises two wings (4) connected by a middle part (5), each of the two wings connected to the second construction element (3), the two wings each defining an arch with an introdos, the intrados of the two wings (4) lay on a common first plane, axes of the two wings (4) lying on the first plane and providing an angle therebetween with a vertex pointing to the first construction element (2), the axes of the two wings (4) meeting at a point within the retaining element (1*a*), the middle part (5, 64) comprising i) an at least partially threaded pin (5*b*), ii) a joint area (5*a*) joining the pin to each of the two wings, iii) a block (5*c*) provided with a threaded hole, a front end of the pin (5*b*) screwed into the threaded hole of the block, and iv) a locking nut (5*d*) screwed on the pin (5*b*, 64*b*), wherein the block (5*c*) is located within the retaining element bearing against the inside rebate (6*a*) of the part of the retaining element counteracting the part in a first direction, and the locking nut (5*d*) is screwed on the pin (5*b*) against the ouside rebate (6*b*) countering the part of the retaining element in a second direction opposite the first direction so that relative displacement between the first construction element (2) and second construction element (3) on the first plane where the axes of the two wings (4) lie is prevented.

16. The connection system according to claim 15, further comprising:

welds (9) that join each of the two wings (4) of the anchoring device (1*b*) to said second construction element (3), wherein, the second construction element is a steel beam, a longitudinal axis of the steel beam being horizontal, a longitudinal axis of the reinforced concrete precast cladding panel being vertical, and relative displacements are prevented in a direction of a bisector of the angle comprised between the axes of the two wings and a the direction perpendicular to said bisector.

17. The connection system according to claim 15, further comprising:

a spring (5*f*) located between the block (5*c*) and an inner wall of the retaining element, the spring counteracting both the block (5*c*) and inside rebate (6*a*) of the retaining element (1*a*).

18. The connection system according to claim 15, wherein, the retaining element (1*a*) comprises a steel section (6) defining a channel element, a connector (7) integral with the section (6) and embedded in concrete of the first construction element (2), and two caps (8) closing the section (6) at the ends thereof, and the section (6) includes two of said inner rebate (6*a*), two of said outer rebate (6*b*), and two side rebates (6*c*).

19. The connection system according to claim 17, wherein, the retaining element (1*a*) comprises a steel section (6) defining a channel element, two connectors (7) integral with the section (6) and embedded in concrete of the first construction element (2), and two caps (8) closing the section (6) at the ends thereof, the section (6) includes two of said inner rebate (6*a*), two of said outer rebate (6*b*), and two side rebates (6*c*), the spring (5*f*) pushes the block (5*c*) against the two inner rebates (6*a*), the two connectors are integral with the inner wall of the retaining element.

20. The connection system according to claim 15, wherein, the joint area contacts an exterior surface of the construction beam.

* * * * *